US011801954B2

(12) United States Patent
Felsecker et al.

(10) Patent No.: US 11,801,954 B2
(45) Date of Patent: Oct. 31, 2023

(54) STRAPPING MACHINE WITH IMPROVED EDGE-PROTECTOR-POSITIONER

(71) Applicant: SIGNODE INDUSTRIAL GROUP LLC, Glenview, IL (US)

(72) Inventors: Douglas Felsecker, Saint Charles, IL (US); Janusz Ciurkot, Palatine, IL (US); Jeffrey D. Termanas, Rolling Meadows, IL (US)

(73) Assignee: Signode Industrial Group LLC, Tampa, FL (US)

( * ) Notice: Subject to any disclaimer, the term of this patent is extended or adjusted under 35 U.S.C. 154(b) by 403 days.

(21) Appl. No.: 16/939,169

(22) Filed: Jul. 27, 2020

(65) Prior Publication Data

US 2021/0047062 A1 Feb. 18, 2021

Related U.S. Application Data

(60) Provisional application No. 62/886,668, filed on Aug. 14, 2019.

(51) Int. Cl.

| | |
|---|---|
| ***B65B 3/18*** | (2006.01) |
| ***B65B 13/18*** | (2006.01) |
| ***B65B 13/04*** | (2006.01) |
| ***B65B 13/32*** | (2006.01) |

(52) U.S. Cl.

CPC ..... *B65B 13/181* (2013.01); *B65B 13/04* (2013.01); *B65B 13/32* (2013.01)

(58) Field of Classification Search

CPC ..... B65B 13/181; B65B 13/04; B65B 13/32; B65B 13/22; B65B 13/18; B65B 13/02

See application file for complete search history.

(56) References Cited

U.S. PATENT DOCUMENTS

| | | | | |
|---|---|---|---|---|
| 3,271,925 | A | 9/1966 | Aubrey | |
| 3,378,987 | A | 4/1968 | Peter | |
| 4,048,839 | A | 9/1977 | Peterpaul | |
| 4,480,460 | A | 11/1984 | Bush et al. | |
| 4,587,791 | A | 5/1986 | Brouse et al. | |
| 4,700,530 | A | 10/1987 | Norberg | |
| 5,289,668 | A | 3/1994 | Meyer | |
| 5,307,664 | A | 5/1994 | Homm | |
| 5,311,996 | A | 5/1994 | Duffy et al. | |
| 5,423,118 | A | 6/1995 | Lotti | |
| 5,551,212 | A | 9/1996 | Odenthal | |
| 5,564,254 | A | 10/1996 | Thimon et al. | |
| 5,596,863 | A * | 1/1997 | Kasel | B65B 13/181 414/789.5 |
| 5,619,838 | A | 4/1997 | Kasel | |

(Continued)

FOREIGN PATENT DOCUMENTS

| | | | |
|---|---|---|---|
| DE | 202013002503 | U1 | 6/2014 |
| EP | 1491447 | A1 | 12/2004 |

(Continued)

OTHER PUBLICATIONS

Extended European Search Report dated Jan. 15, 2021.

*Primary Examiner* — Anna K Kinsaul
*Assistant Examiner* — Himchan Song
(74) *Attorney, Agent, or Firm* — Neal, Gerber & Eisenberg LLP

(57) ABSTRACT

Various embodiments of the present disclosure provide a strapping machine with an improved edge-protector positioner.

8 Claims, 20 Drawing Sheets

(56) References Cited

U.S. PATENT DOCUMENTS

| | | | | |
|---|---|---|---|---|
| 5,878,548 | A | 3/1999 | Sauer et al. | |
| 6,540,080 | B2 | 4/2003 | Moreyra | |
| 7,213,381 | B2 | 5/2007 | Zitella et al. | |
| 7,383,952 | B2 | 6/2008 | Kruelle et al. | |
| 7,428,865 | B1 * | 9/2008 | Kasel | B65B 27/10 53/529 |
| 10,017,283 | B2 | 7/2018 | Kastner et al. | |
| 10,099,808 | B2 | 10/2018 | Termanas et al. | |
| 2002/0014052 | A1 | 2/2002 | Suolahti | |
| 2003/0051439 | A1 * | 3/2003 | Lancaster, III | B65B 11/025 53/399 |
| 2004/0261360 | A1 * | 12/2004 | Cere | B65B 13/181 53/410 |
| 2005/0108989 | A1 | 5/2005 | Dickner | |
| 2011/0219845 | A1 | 9/2011 | Schurder et al. | |
| 2012/0055123 | A1 * | 3/2012 | Brunson | B65B 9/135 53/558 |
| 2014/0306054 | A1 * | 10/2014 | Termanas | B65B 13/18 242/615.3 |
| 2014/0311092 | A1 * | 10/2014 | Flores | B25F 1/00 53/410 |
| 2016/0114918 | A1 | 4/2016 | Kastner | |
| 2016/0152363 | A1 * | 6/2016 | Termanas | B65B 13/181 53/410 |
| 2018/0244413 | A1 | 8/2018 | Oehm et al. | |
| 2020/0139657 | A1 * | 5/2020 | Termanas | B30B 9/3007 |
| 2021/0047062 | A1 * | 2/2021 | Felsecker | B65B 13/181 |
| 2022/0177174 | A1 * | 6/2022 | Schulz | B65B 43/126 |

FOREIGN PATENT DOCUMENTS

| | | | |
|---|---|---|---|
| EP | 2700577 | B1 | 10/2014 |
| EP | 2660158 | B1 | 1/2015 |
| EP | 2700578 | B1 | 1/2015 |
| EP | 2700579 | B1 | 3/2015 |
| EP | 2778075 | B1 | 6/2015 |
| EP | 2778076 | B1 | 6/2015 |
| EP | 2733077 | B1 | 9/2015 |
| EP | 2878541 | B1 | 4/2016 |
| JP | 2004331077 | A | 11/2004 |
| WO | 2020197847 | A1 | 1/2020 |

* cited by examiner

STRAPPING MACHINE WITH IMPROVED EDGE-PROTECTOR-POSITIONER

PRIORITY CLAIM

This patent application claims priority to and the benefit of U.S. Provisional Patent Application No. 62/886,668, which was filed on Aug. 14, 2019, the entire contents of which are incorporated herein by reference.

FIELD

The present disclosure relates to strapping machines, and more particularly to strapping machines configured to position edge protectors on the corners of a load so those edge protectors are positioned between the strap and the load after a tensioned strap loop is formed around the load.

BACKGROUND

A strapping machine forms a tensioned loop of plastic strap (such as polyester or polypropylene strap) or metal strap (such as steel strap) around a load. A typical strapping machine includes a support surface that supports the load, a strap chute that defines a strap path and circumscribes the support surface, a strapping head that forms the strap loop and is positioned in the strap path, a controller that controls the strapping head to strap the load, and a frame that supports these components.

To strap the load, the strapping head first feeds strap (leading strap end first) from a strap supply into and through the strap chute (along the strap path) until the leading strap end returns to the strapping head. While holding the leading strap end, the strapping head retracts the strap to pull the strap out of the strap chute and onto the load and tensions the strap to a designated strap tension. The strapping head cuts the strap from the strap supply to form a trailing strap end and attaches the leading and trailing strap ends to one another, thereby forming a tensioned strap loop around the load.

To protect the corners of the loads from damage, certain strapping machines include edge-protector positioners with shuttles configured to position edge protectors on the corners of the loads so those edge protectors are positioned between the strap and the load after the tensioned strap loop is formed around the load. FIG. 1 shows one example load L with edge protectors E (only one of which is labeled) positioned on corners C of the load L between the strap S and the load L. One of these strapping machines has an edge-protector positioner with a shuttle including an optical sensor. To position an edge protector on a load, the shuttle moves toward and eventually contacts the load. Mechanical assemblies of the shuttle operate to eject the edge protector onto the load responsive to contacting the load just as the optical sensor detects the load. In response to the optical sensor detecting the load, the shuttle reverses course and moves back to its home position.

One issue with this known edge-protector positioner is that before the shuttle reaches the load the optical sensor may sense an object other than the load, such as a bag or top sheet on the load. In these instances, since the shuttle does not contact the load (or does not contact the load long enough) the shuttle moves back to its home position before ejecting the edge protector onto the load. This lack of edge protectors can cause the strap or other objects to damage the corners of the load. And if edge protection is required, the strap must be removed and the load re-strapped, wasting time and material.

SUMMARY

Various embodiments of the present disclosure provide a strapping machine with an improved edge-protector positioner.

Various embodiments of the strapping machine of the present disclosure comprise a frame; a load supporter supported by the frame; a shuttle movable relative to the load supporter between a home position and an ejection position, the shuttle configured to receive an edge protector, the shuttle comprising: an ejector movable from a home position to an ejection position to eject the edge protector from the shuttle; and an ejection sensor configured to detect the ejector; a strapping head; and a controller operably connected to the shuttle to control the shuttle to move between the home and ejection positions and communicatively connected to the ejection sensor, the controller configured to: control the shuttle to move from the home position to the ejection position; responsive to an ejection condition being met based on feedback from the ejection sensor as the shuttle moves to the ejection position, control the shuttle to move back to the home position; and control the strapping head to strap the load.

Various methods of operating a strapping machine of the present disclosure to position an edge protector on a load and to strap the load comprise moving a shuttle carrying the edge protector from a home position toward the load; ejecting, via an ejector of the shuttle, the edge protector onto the corner of the load; after an ejection condition is met based on feedback from an ejection sensor configured to detect the ejector, moving the shuttle back to the home position; and strapping the load.

BRIEF DESCRIPTION OF THE FIGURES

In FIG. 6A the shuttle of the shuttle assembly is at its home position, and in FIG. 6B the shuttle is at its ejection position.

In FIG. 7A the folder of the shuttle is in its edge-protector-receive configuration, and in FIG. 7B the folder is in its fold configuration.

DETAILED DESCRIPTION

Figure 1:
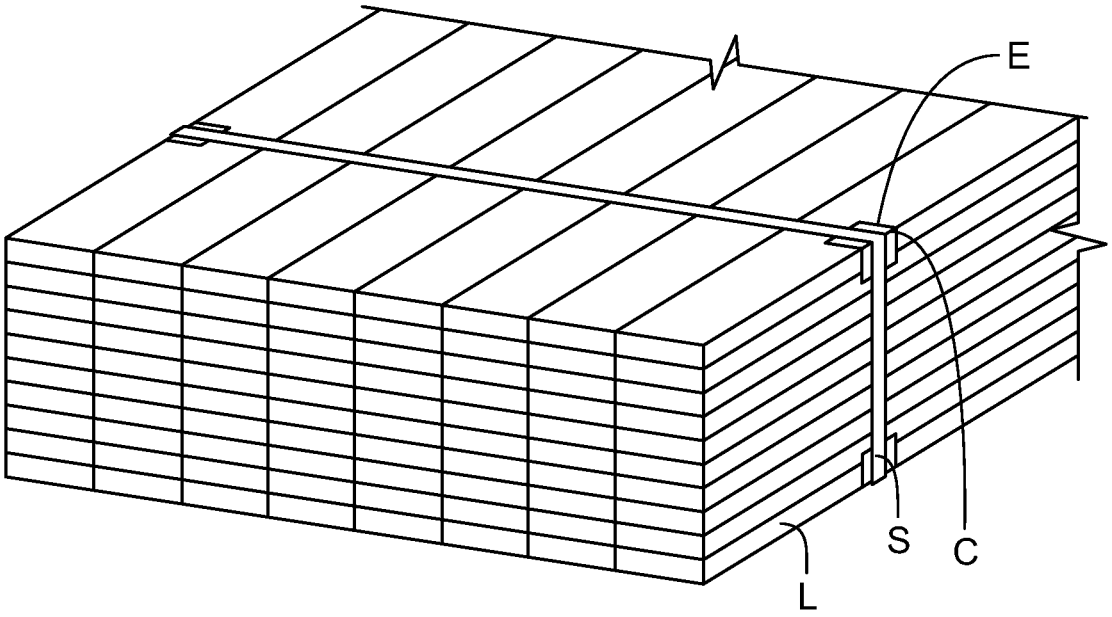
FIG. 1 (Prior Art)
FIG. 1 is a perspective view of a load of lumber secured with a tensioned loop of strap. Edge protectors are positioned on the corners of the load and separate the strap from the load.
Figure 2:
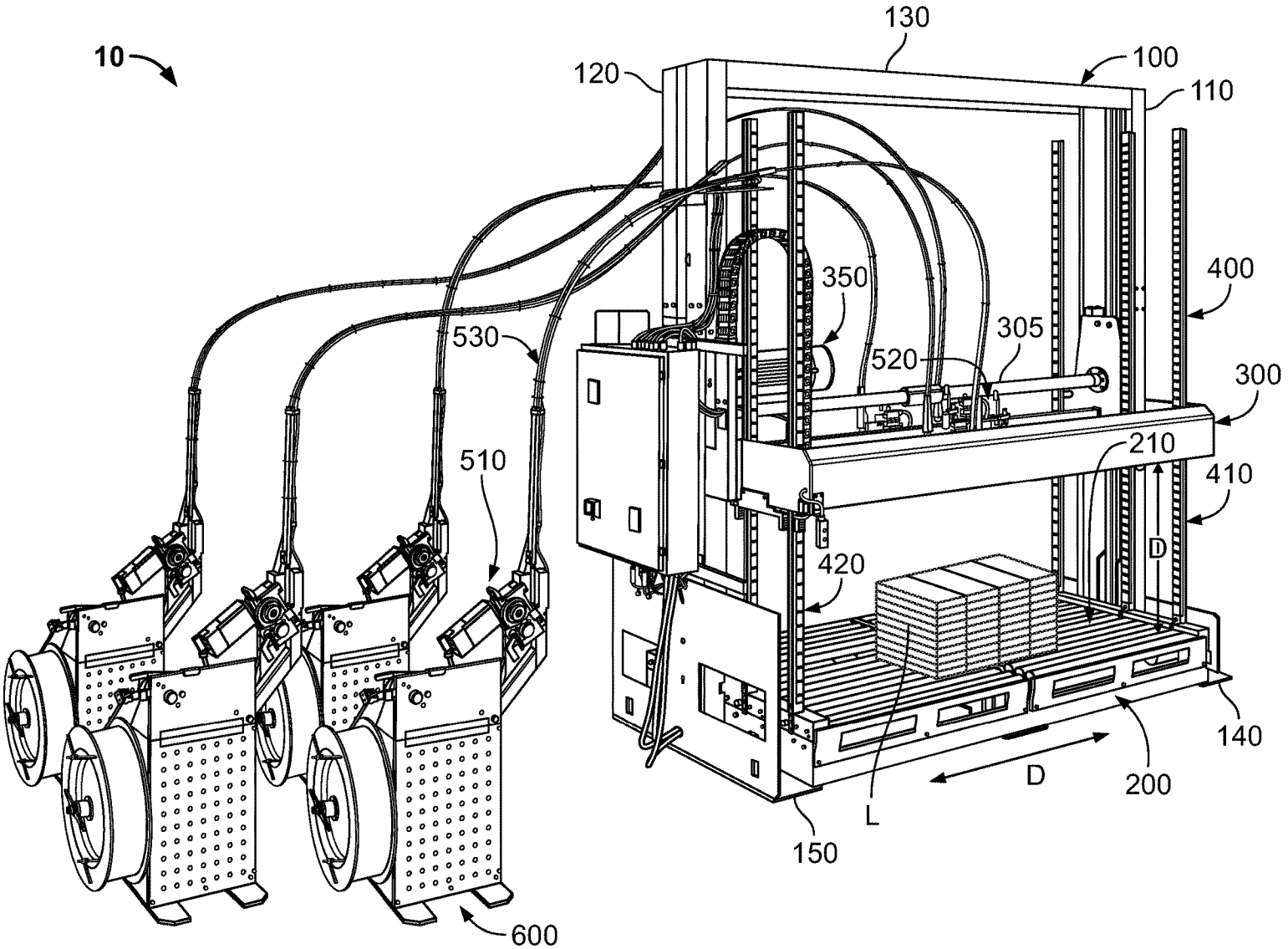
FIG. 2 is a perspective view of one example embodiment of a strapping machine of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

FIGS. 2-14C show one embodiment of a strapping machine 10 of the present disclosure and components thereof. The strapping machine 10 is configured to stabilize a load L, position edge protectors E on the corners C of the load L, and tension and seal strap S to itself around the load L such that the edge protectors E are positioned between the strap S and the load L, as shown in FIG. 1.

As best shown in FIGS. 2-4B, The strapping machine 10 includes a frame 100, a load supporter 200, a top platen 300, a top-platen actuator 350, multiple strap chutes 400 (only one of which is labeled for clarity), multiple strapping heads 500 (only one of which is labeled for clarity) each configured to draw strap from a respective strap supply 600 (only one of which is labeled for clarity), multiple edge-protector positioners 700 (only one of which is shown for clarity), and a controller 1800.

The frame 100 is configured to support some (or all) of the other components of the strapping machine 10. In this example embodiment, the frame 100 includes first and second spaced-apart upstanding legs 110 and 120, a connector 130 that spans and connects the upper ends of the first and second legs 110 and 120, and first and second feet 140 and 150 connected to the lower ends of the first and second legs 110 and 120, respectively. Although not shown, the first and second legs 110 and 120 each include a vertically extending toothed rack to enable the top platen 300 to move relative to the first and second legs 110 and 120 in a rack-and-pinion fashion, as described below. This is merely one example of a configuration of components that form the frame 100, and any other suitable configuration of any other suitable components may form the frame 100 in other embodiments.

The load supporter 200 is positioned between the first and second legs 110 and 120 of the frame 100 and below the connector 130 of the frame 100. The load supporter 200 is configured to support loads as they are compressed and strapped by and as they move through the strapping machine 10. The load supporter 200 includes a support surface 210 on which the loads are positioned during compression and strapping and over which loads move as they move through the strapping machine 10. In this example embodiment, the support surface 210 includes multiple rollers that facilitate movement of the load through the strapping machine 10. The rollers may be driven or undriven. In other embodiments, the support surface includes a driven conveyor instead of rollers.

The top platen 300 is supported by the first and second legs 110 and 120 above the load supporter 200 and is vertically movable relative to the load supporter 200 so the top platen 300 can adjust to loads of different heights and apply a compressive force to the loads before and during strapping. In this example embodiment, the top platen 300 includes two rotatable pinions (not shown) fixed to a pinion shaft 305 such that the pinions and the pinion shaft 305 rotate together. The pinion shaft 305 spans the first and second legs 110 and 120 such that one pinion meshes with the toothed rack in the first leg 110 and the other pinion meshes with the toothed rack in the second leg 120. In this configuration, rotation of the pinions (which rotate together via their fixed connection to the pinion shaft 305) under control of the top-platen actuator 350 (described below) causes the pinions to climb or descend their respective toothed racks such that the top platen 300 moves away from or toward the support surface 210 of the load supporter 200 (i.e., upward or downward, as described in more detail below). The top platen 300 also includes one or more compression surfaces 310 (not shown, but numbered for ease of reference) on its underside for contacting and applying the compressive force to the load to stabilize the load (and in certain instances, such as when the load is formed from corrugated, compress the load).

The top-platen actuator 350 is any suitable actuator, such as an electric motor, operably connected to the top platen 300 to move the top platen 300 relative to the first and second legs 110 and 120 toward and away from the support surface 210 of the load supporter 200 (i.e., downward and upward). In this example embodiment, the top-platen actuator 350 is operably connected to the pinions and the pinion shaft 305 of the top platen 300 via gearing (not shown) such that rotation of an output shaft (not shown) of the top-platen actuator 350 results in rotation of the pinions (and the pinion shaft 305) and vertical movement of the top platen 300. In one example embodiment, an output gear (not shown) of the gearing is meshed with one of the pinions such that rotation of the output gear (caused by rotation of the output shaft of the top-platen actuator 350) directly causes that pinon to rotate, which in turn causes the pinion shaft 305 and the other pinion to rotate. Rotating the output shaft of the top-platen actuator 350 in one direction results in movement of the top platen 300 away from the support surface 210, and rotation of the output shaft in the opposite direction results in movement of the top platen 300 toward the support surface 210. This is merely one example embodiment of the top-platen actuator, and any suitable actuator may be employed (such as a hydraulic or pneumatic actuator). Additionally, any other suitable manner of controlling vertical movement of the top platen 300 may be employed (e.g., hydraulic or pneumatic cylinders, belt-and-pulley assemblies, and the like), as the rack-and-pinion configuration is merely one example embodiment.

The strap chute 400 circumscribes the support surface 210 and defines a strap path that the strap follows when fed through the strap chute 400 and from which the strap is removed when retracted. The strap chute 400 includes two spaced-apart first and second upstanding legs 410 and 420, an upper connecting portion (not shown) that spans the first and second legs 410 and 420 and is positioned in the top platen 300, a lower connecting portion (not shown) that spans the first and second legs 410 and 420 and is positioned in the load supporter 200, and elbows (not labeled) that connect these portions. As is known in the art, the radially inward wall of the strap chute 400 is formed from multiple overlapping gates that are spring-biased to a closed position that enables the strap to traverse the strap path when fed through the strap chute 400. When the strapping head 500 later exerts a pulling force on the strap to retract the strap, the pulling force overcomes the biasing force of the springs and causes the gates to pivot to an open position, thereby releasing the strap from the strap chute so the strap contacts the load as the strapping head 500 continues to retract the strap. One example of this strap chute 400 is described in U.S. Pat. No. 7,428,865, the contents of which are incorporated herein by reference, though the strapping machine 10 may include any other suitable strap chute.

The strapping head 500 is configured to form a tensioned strap loop around the load by feeding the strap through the strap chute 400 along the strap path, holding the leading strap end while retracting the strap to remove it from the strap chute 400 so it contacts the load, tensioning the strap around the load to a designated tension, cutting the strap from the strap supply to form a trailing strap end, and connecting the leading strap end and trailing strap end to one another. In this example embodiment, the strapping head 500 is a modular strapping head including independently removable and replaceable feed and sealing modules 510 and 520. The feed module 510, which is configured to feed, retract, and tension the strap, is mounted to a frame (not labeled) of the strap supply 600. That is, in this example embodiment, the feed module 510 is located remote from the strapping machine 10 (though in other embodiments the feed module 510 may be supported by the frame 100 or any other suitable component of the strapping machine 10). The top platen 300 supports the sealing module 520, which is configured to hold the leading strap end, cut the strap from the strap supply, and connect the leading strap end and trailing strap end to one another. A strap guide 530 extends between the feed and sealing modules 510 and 520 and is configured to guide the strap as it moves between the modules.

Modular strapping heads of this type are known in the art. One example is described in U.S. Pat. No. 7,377,213, the contents of which are incorporated herein by reference, though the strapping machine 10 may include any suitable modular strapping head. In other embodiments, the strapping head 500 is any suitable non-modular strapping head (i.e., a strapping head that is not comprised of independently removable and replaceable feed and sealing modules). The manner of attaching the leading and trailing strap ends to one another depends on the type of strapping machine and the type of strap. Certain strapping machines configured for plastic strap include strapping heads with friction welders, heated blades, or ultrasonic welders configured to attach the leading and trailing strap ends to one another. Some strapping machines configured for plastic strap or metal strap include strapping heads with jaws that mechanically deform (referred to as "crimping" in the industry) or cut notches into (referred to as "notching" in the industry) a seal element positioned around the leading and trailing strap ends to attach them to one another. Other strapping machines configured for metal strap include strapping heads with punches and dies configured to form a set of mechanically interlocking cuts in the leading and trailing strap ends to attach them to one another (referred to in the strapping industry as a "sealless" attachment). Still other strapping machines configured for metal strap include strapping heads with spot, inert-gas, or other welders configured to weld the leading and trailing strap ends to one another.

Figure 4A:
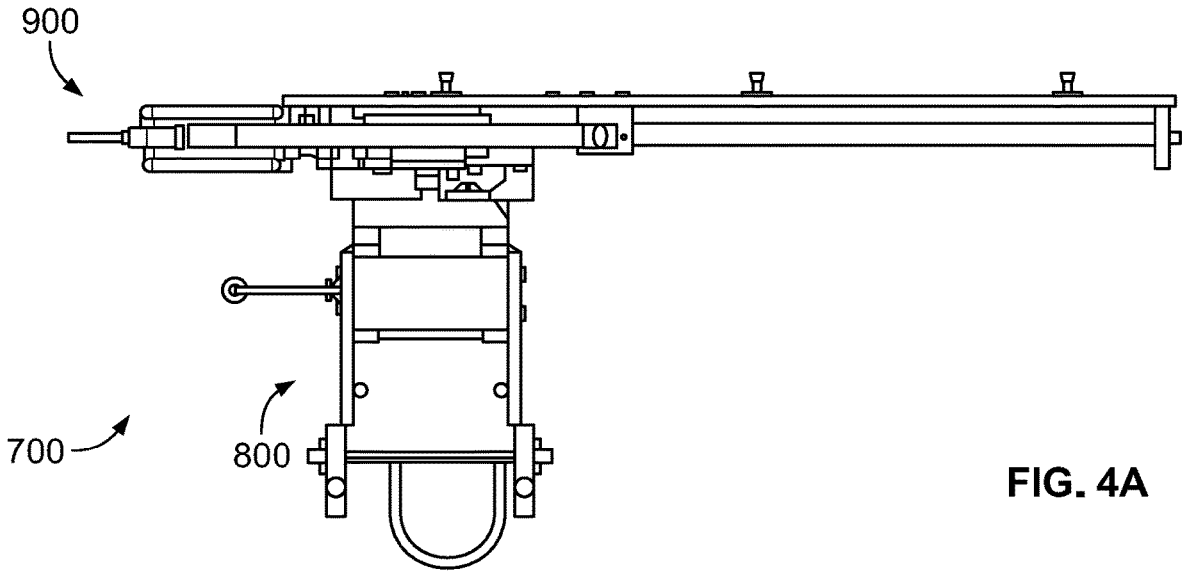
FIGS. 4A and 4B are top plan and front elevational views, respectively, of an edge-protector positioner of the strapping machine of FIG. 2.
Figure 4B:
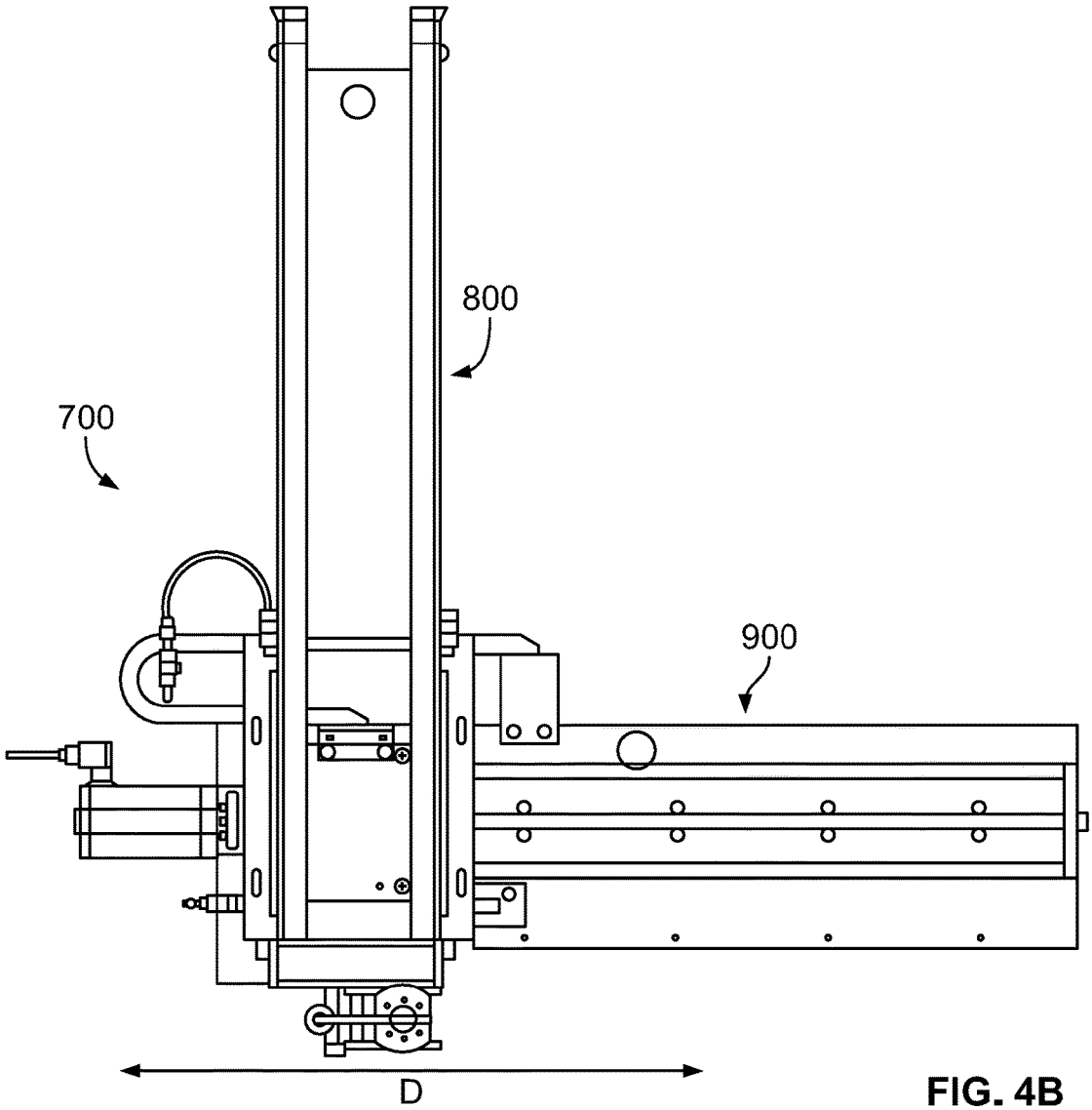

The edge-protector positioner 700 is best shown in FIGS. 4A and 4B and is mounted to the top platen 300 and configured to move edge protectors in the direction D (laterally inward relative to the load L) to position the edge protectors on a corner of the load. The edge-protector positioner 700 includes a magazine assembly 800 and a shuttle assembly 900.

Figure 5:
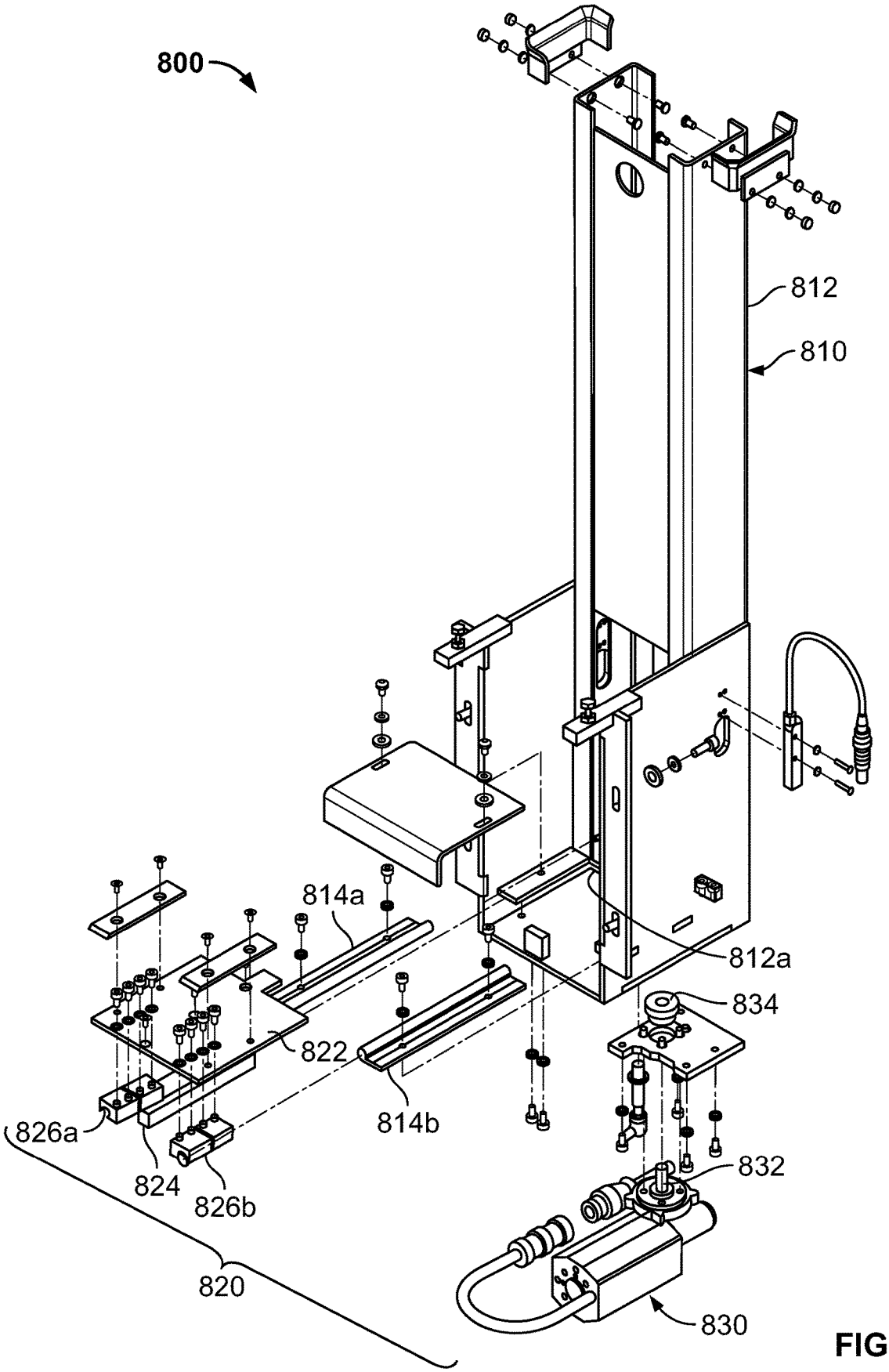
FIG. 5 is a partially exploded perspective view of the magazine assembly of the edge-protector positioner of FIGS. 4A and 4B.

The magazine assembly 800 is best shown in FIG. 5 and is configured to store multiple edge protectors E having a generally planar orientation stacked atop one another and to deliver individual edge protectors E from the stack to the shuttle assembly 900. The magazine assembly 800 includes a storage magazine 810, an edge-protector feeder 820, and a magazine actuator 830.

The storage magazine 810 includes a frame 812 that is mountable to the top platen 300 or any other suitable component of the strapping machine 10 and that is sized, shaped, and otherwise configured to store the stack of edge protectors E. The frame 812 defines an opening 812*a* sized, shaped, positioned, oriented, and otherwise configured to enable a single edge protector E to move therethrough when being fed to the shuttle assembly 900, as described in more detail below. The storage magazine 810 also includes spaced-apart feeder-plate-mounting rails 814*a* and 814*b* mounted to the frame 812. Although not shown here, the storage magazine 810 includes an edge-protector-biasing assembly configured to bias the stack of edge protectors E toward the bottom of the frame 812 to ensure proper positioning for feeding.

The edge-protector feeder 820 includes a feed plate 822 having a thickness equal to or slightly less than the thickness of one of the edge protectors E, a rack gear 824 mounted to an underside of the feed plate 822, and spaced-apart linear bearings 826*a* and 826*b* mounted to the underside of the feed plate 822 on opposite sides of the rack gear 824.

The magazine actuator 830 includes an electric motor in this embodiment and includes an output shaft 832 and a drive gear 834 fixedly mounted to the output shaft 832 for rotation therewith. The magazine actuator 830 is mounted to the frame 812 of the storage magazine 810 so the drive gear 834 drivingly engages (and here, meshes with) the rack gear 824 of the edge-protector feeder 820. The magazine actuator 830 is thus operably coupled to the edge-protector feeder 820 (via the drive gear/rack gear engagement) to move the edge-protector feeder 820 relative to the storage magazine 810 in a reciprocating manner, as described below.

Separation of individual edge protectors E from the stack is accomplished by cooperation of the feed plate 822 along with the opening 812*a* at the bottom of the frame 812 of the storage magazine 810. As such, as the feed plate 822 reciprocates via clockwise and counter-clockwise rotation of the output shaft 832 of the magazine actuator 830, the feed plate 822 contacts an edge protector E along a forward edge of the feed plate 822. The forward edge of the feed plate 822 pushes the edge protector E from the stack through the opening 812*a* into the edge-protector-receiving regions of the shuttle 1000 of the shuttle assembly 900, as described below.

The shuttle assembly 900 is best shown in FIGS. 6A, 6B, and 13A-14C and is configured to receive an edge protector in a generally planar orientation from the magazine assembly 800, fold the edge protector into an L-shaped orientation, move the edge protector in the direction D to a corner of the load, and eject the edge protector onto the corner of the load. The shuttle assembly 900 includes a support 910, shuttle-mounting rails 920*a* and 920*b*, a shuttle actuator 940, and a shuttle 1000.

Figure 6A:
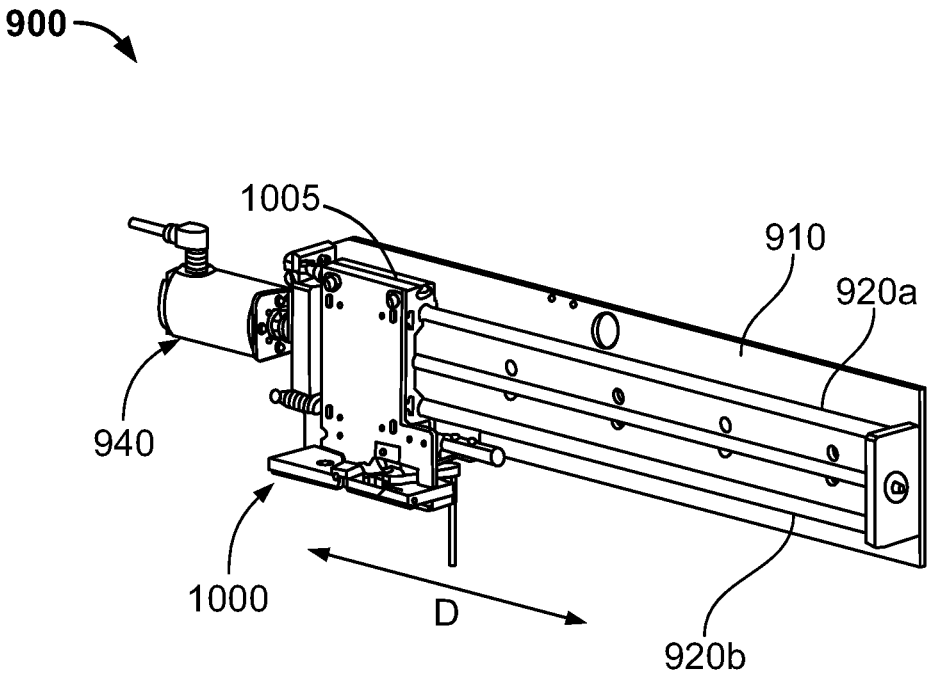
FIGS. 6A and 6B are perspective views of the shuttle assembly of the edge-protector positioner of FIGS. 4A and 4B.
Figure 6B:
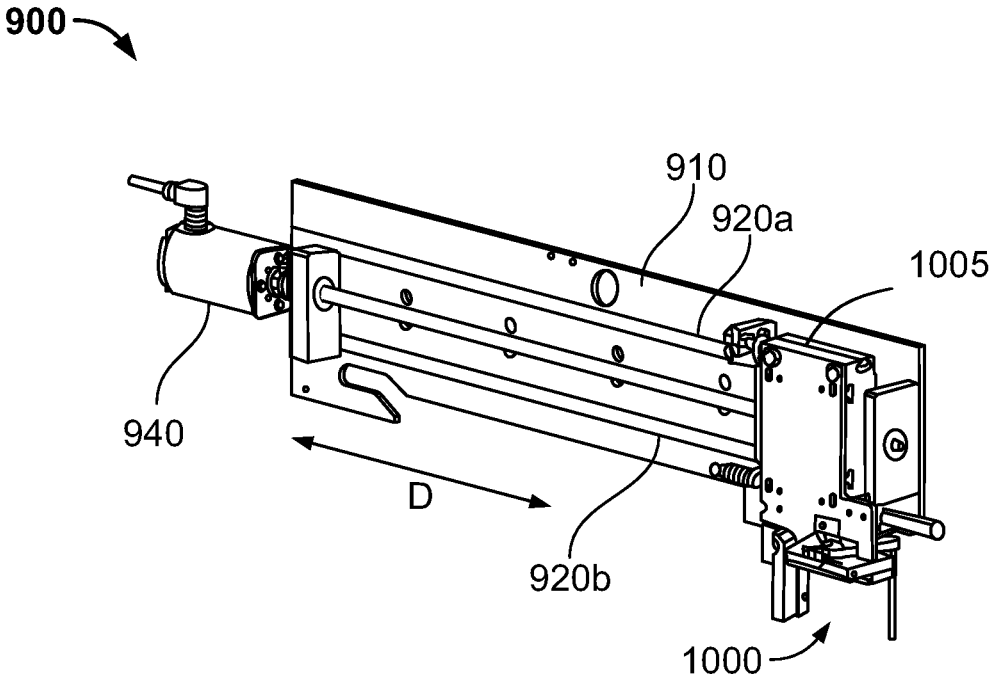
Figure 14A:
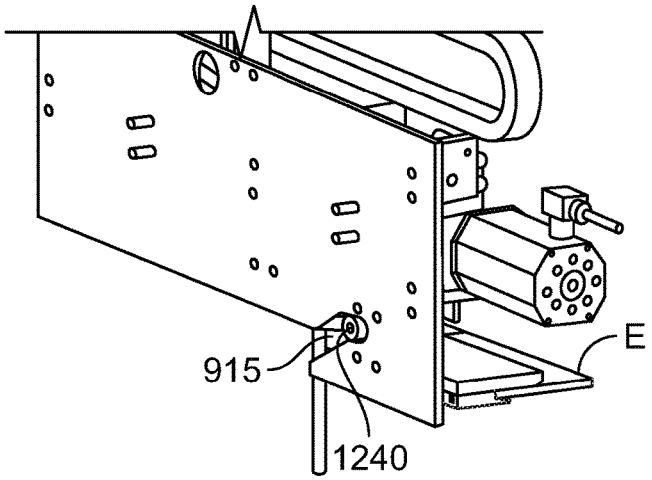
FIGS. 14A-14C are perspective views of the shuttle assembly from the opposite side from that shown in FIGS. 13A-13C.
Figure 14B:
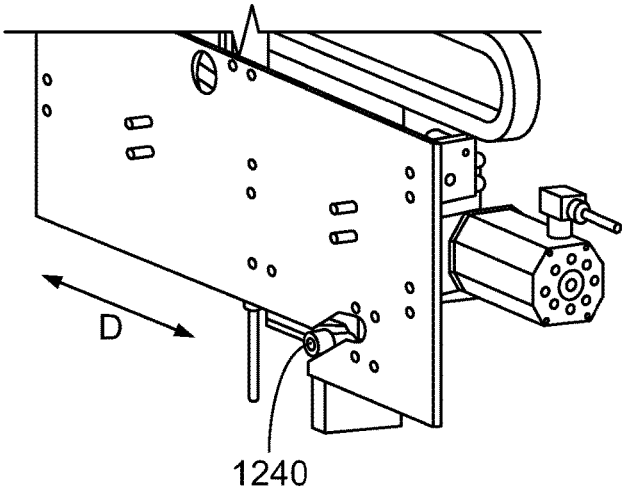
Figure 14C:
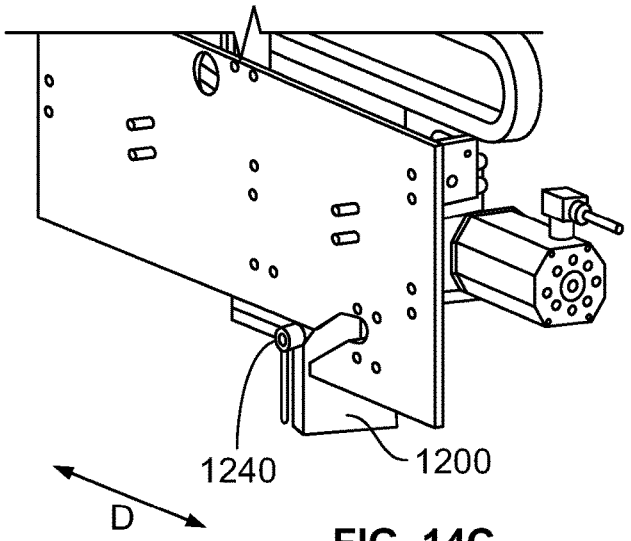

The support 910 may be any suitable plate or other component sized, shaped, and otherwise configure to support various components of the shuttle assembly 900. As best shown in FIGS. 14A-14C, a generally angled track 915 is defined in the support 910 and is configured to engage part of the shuttle 1000, as described below, to cause the shuttle 1000 to fold the edge protector E in to an L-shape. The shuttle-mounting rails 920 are mounted to the support and spaced-apart from and parallel to one another. The shuttle 1000 (and particularly, the carriage 1005 of the shuttle 1000) is slidably mounted to the shuttle-mounting rails 920 and is movable relative to the rails 920 from a home position (FIG. 6A) to an ejection position (FIG. 6B). The shuttle actuator 940 is operably connected to the shuttle 1000 to move the shuttle 1000 between the home and ejection positions. The shuttle actuator 940 may be any suitable type of actuator, and includes an electric screw-drive actuator in this example embodiment.

The shuttle 1000 is best shown in FIGS. 7A-14C and is configured to receive an edge protector E in a generally planar orientation, fold the edge protector into an L-shaped orientation, and eject the L-shaped edge protector onto the corner of the load. The shuttle 1000 includes a carriage 1005, mounting plate 1010, a bracket 1020, a folder (not labeled) including a fixed folder portion 1100 and a movable folder portion 1200, an ejector 1300, an ejector-ejector-biasing element 1400 (here a torsion spring, though any suitable biasing element may be used), an ejection sensor 1500, and a retaining element 1600.

Figure 7A:
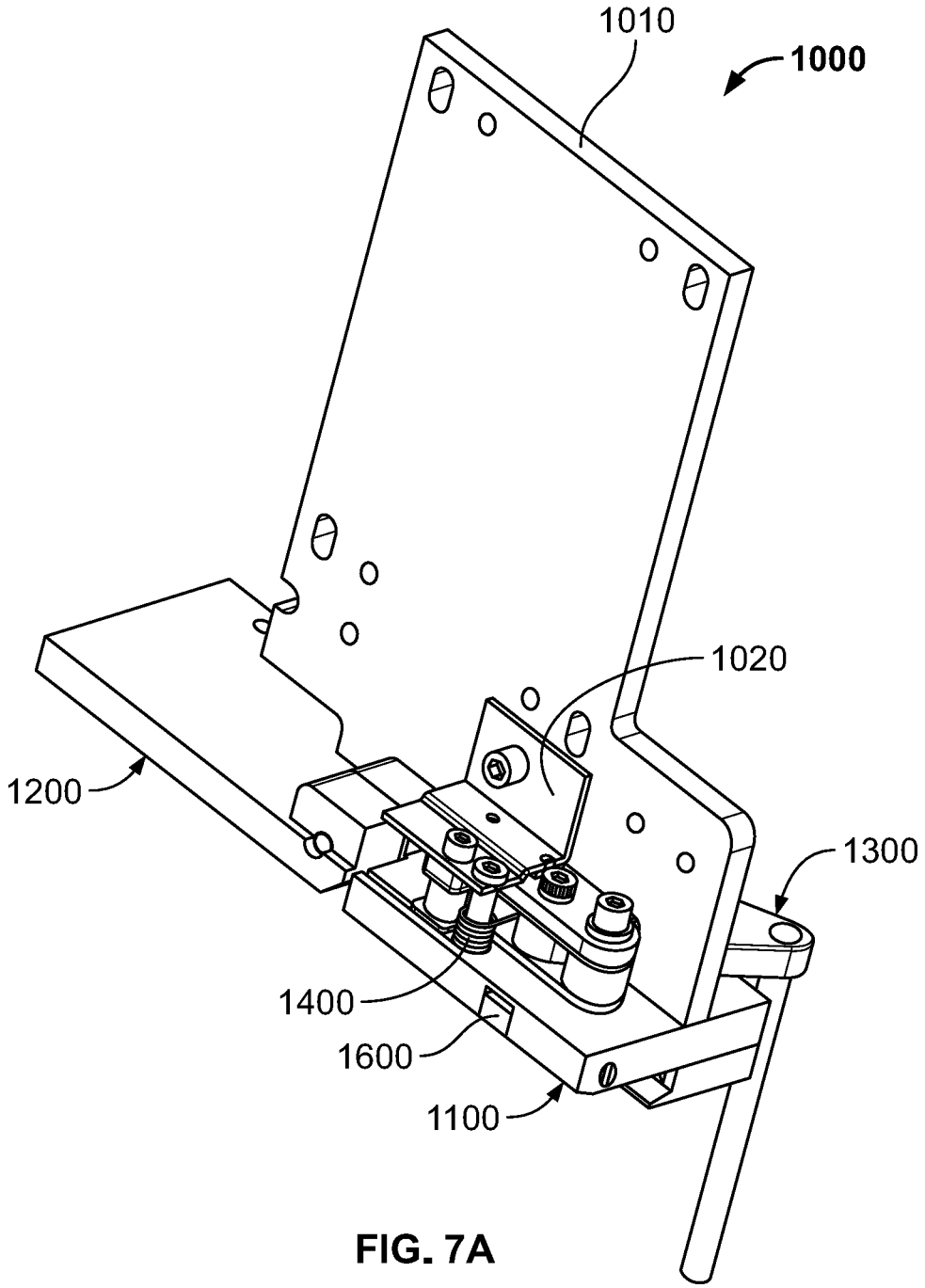
FIGS. 7A and 7B are perspective views of the shuttle of the shuttle assembly of FIGS. 6A and 6B with the carriage removed.
Figure 7B:
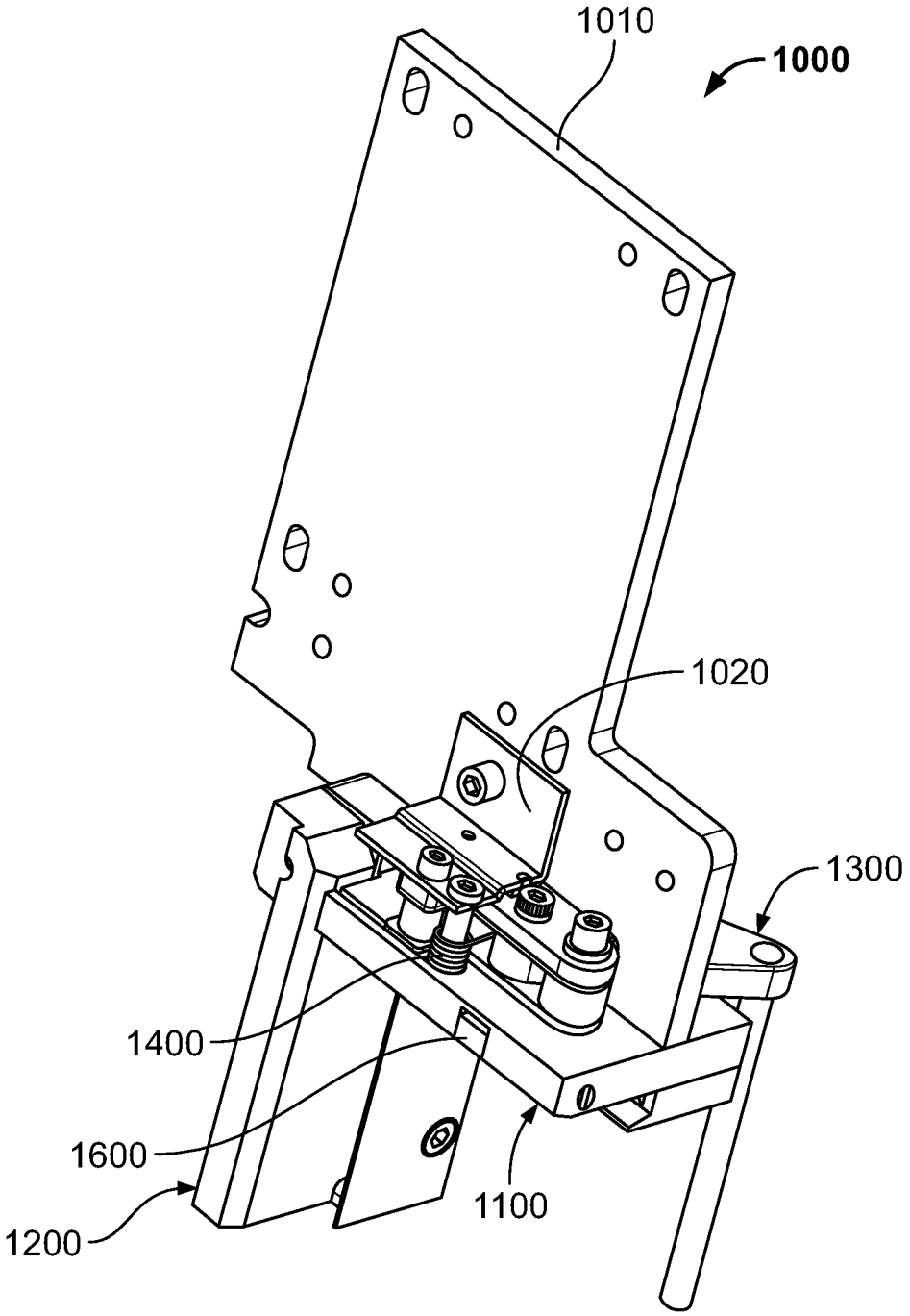

The carriage 1005 is slidably mounted to the rails 920*a* and 920*b*. The mounting plate 1010 and the bracket 1020, which are shown in FIGS. 7A and 7B but not in certain other Figures for clarity, are used to mount the folder to the carriage 1005. Specifically, the mounting plate 1010 is connected to the carriage 1005, and the bracket 1020 connects the mounting plate 1010 to the fixed folder portion 1100 via suitable fasteners or in any other suitable manner. The mounting plate 1010 and the bracket 1020 may have any suitable size and shape and be made of any suitable material.

The folder including the fixed folder portion 1100 and the movable folder portion 1200 is best shown in FIGS. 7A-11 and is configured to receive the edge protector E in the generally planar orientation and fold the edge protector E into the L-shaped orientation. The movable folder portion 1200 is pivotably connected to the fixed folder portion 1100 about a pivot 1030 (here a pivot pin, though any other suitable type of pivot may be used). FIG. 7A shows the fixed folder portion 1100 and the movable folder portion 1200 in a receiving orientation in which the fixed and movable folder portions are generally coplanar to one another so they are configured to receive the edge protector E from the magazine assembly 800 (as described below). The movable folder portion 1200 is movable relative to the fixed folder portion 1100 so the movable folder portion 1200 is transverse to (such as perpendicular to) the fixed folder portion 1100 and the fixed and movable folder portions are in a fold configuration, as shown in FIG. 7B. Movement of the movable folder portion 1200 in this manner folds an edge protector held by the folder, as described below.

The fixed folder portion 1100 includes a fixed plate 1110 and a fixed shoe 1120 connected to the underside of the fixed plate 1110. The fixed shoe 1120 includes a support surface 1121, and a first edge-protector-receiving region 1125 that is sized, shaped, and otherwise configured to receive part of the edge protector is formed between the support surface 1121 and the underside of the fixed plate 1110. As best shown in FIG. 12C, the fixed plate 1110 defines a curved slot 1115 therethrough sized, shaped, positioned, and otherwise configured to receive an ejection finger 1330 of the ejector 1300, as described below. A retaining finger 1117 extends downward from the underside of the fixed plate 1110 and into the first edge-protector-receiving region 1125. When an edge protector is received in the first edge-protector receiving region 1125, the retaining finger 1117 helps retain the edge protector in place.

The movable folder portion 1200 includes a movable plate 1210 and a movable shoe 1220 connected to the underside of the movable plate 1210. The movable shoe 1220 includes a support surface 1221, and a second edge-protector-receiving region 1225 that is sized, shaped, and otherwise configured to receive part of the edge protector is formed between the support surface 1221 and the underside of the movable plate 1210. The movable folder portion 1200 also includes an L-shaped arm 1230 fixedly connected to one end of the movable plate 1210. A roller 1240 is mounted to the arm 1230 and rotatable relative to the arm 1230.

Figure 11:
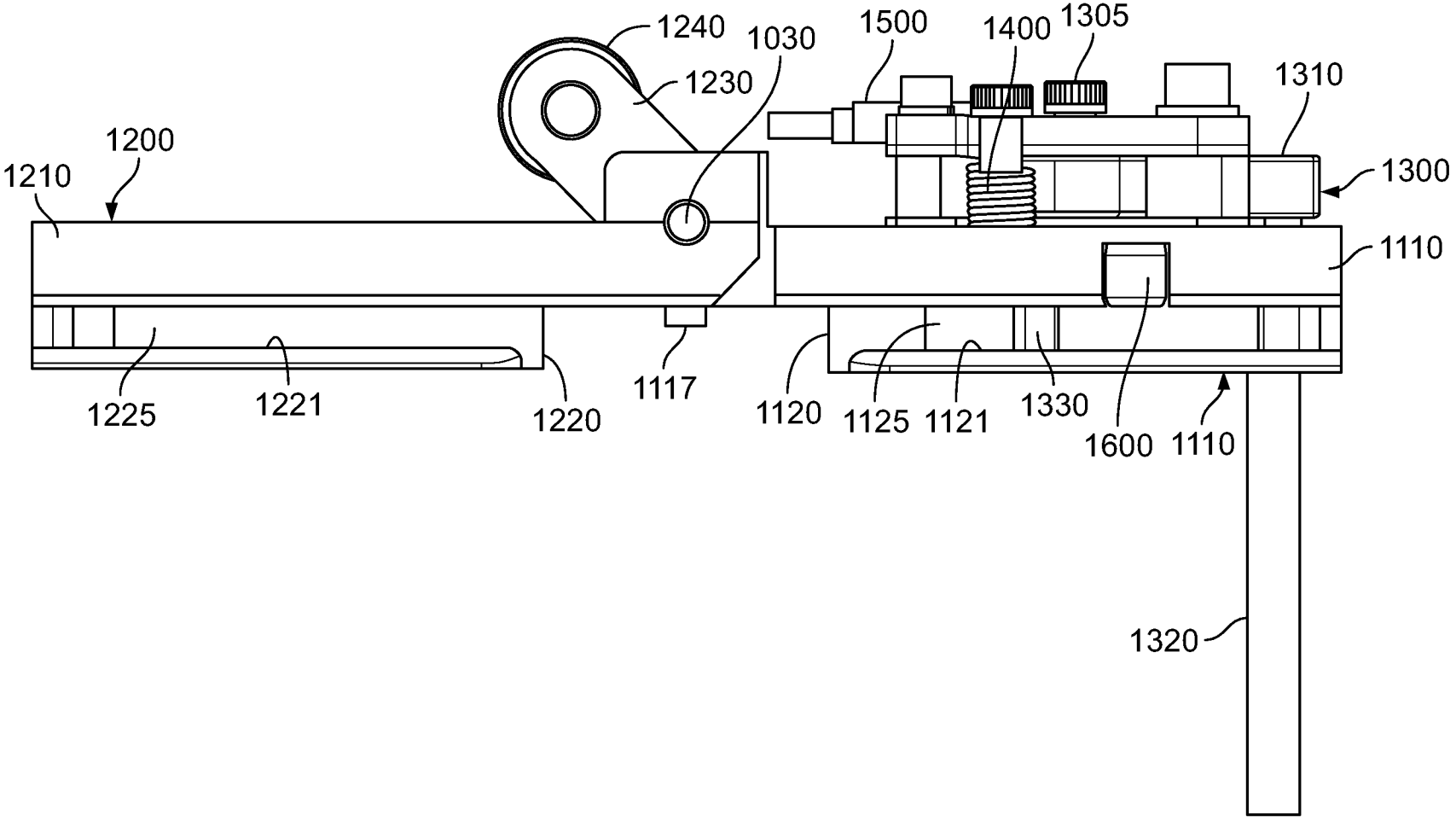
FIG. 11 is a front elevational view of the shuttle of FIGS. 7A and 7B with certain components removed.
Figure 12A:
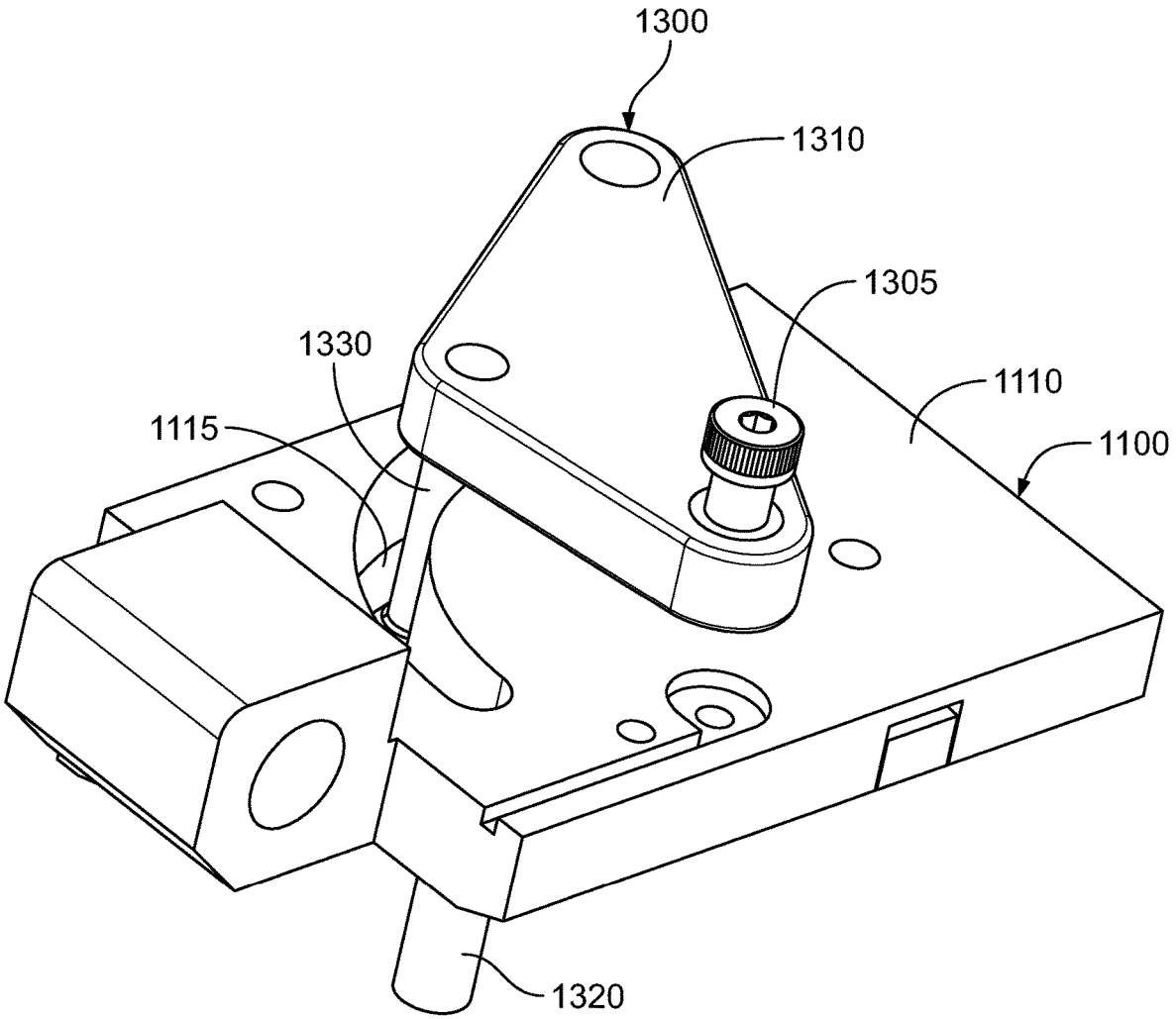
FIGS. 12A-12E are views of the shuttle of FIGS. 7A and 7B with certain components removed. The ejector of the shuttle is in its home position in FIGS. 12A-12C and in its ejection position in FIGS. 12D and 12E.
Figure 12B:
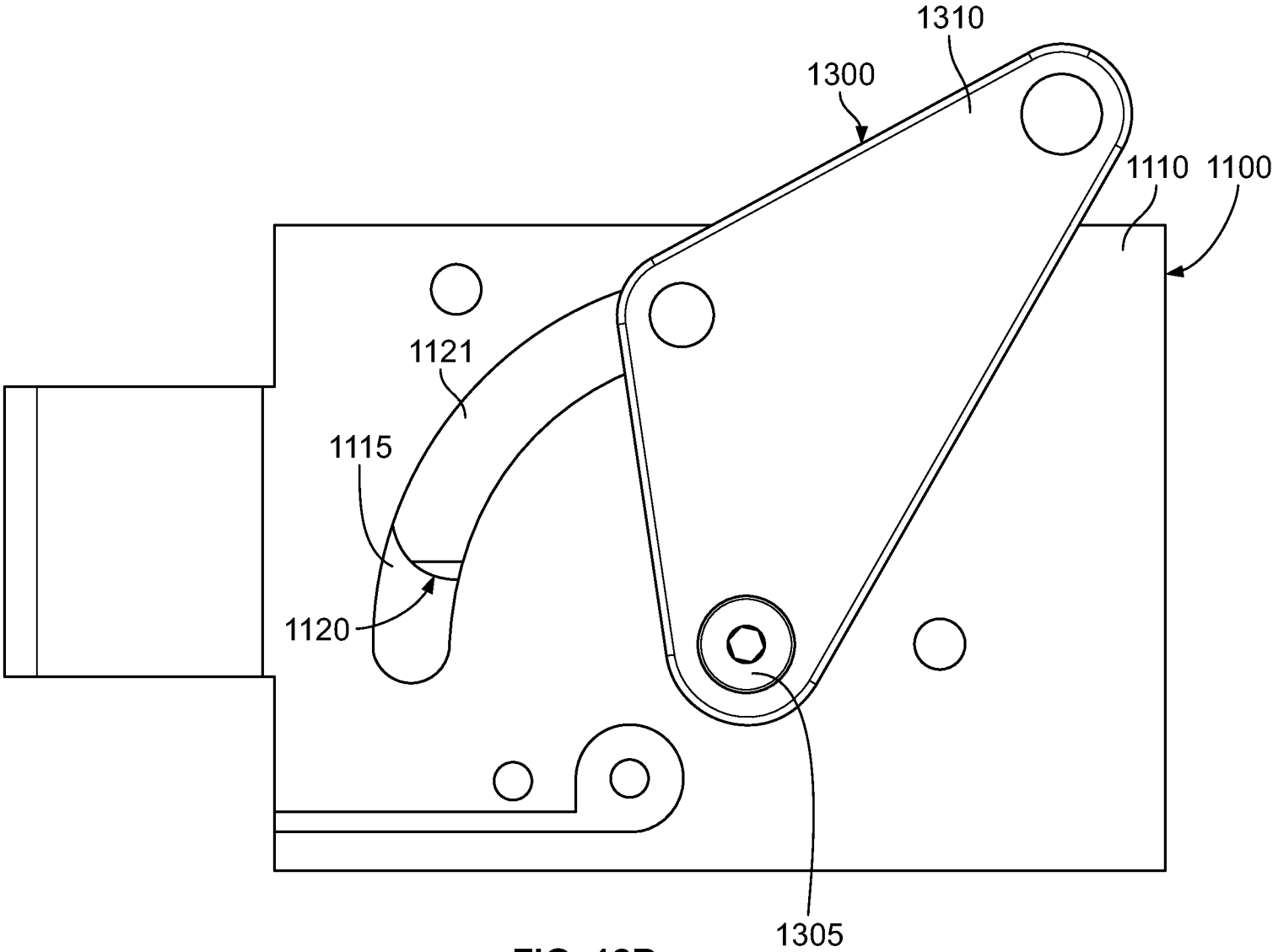
Figure 12C:
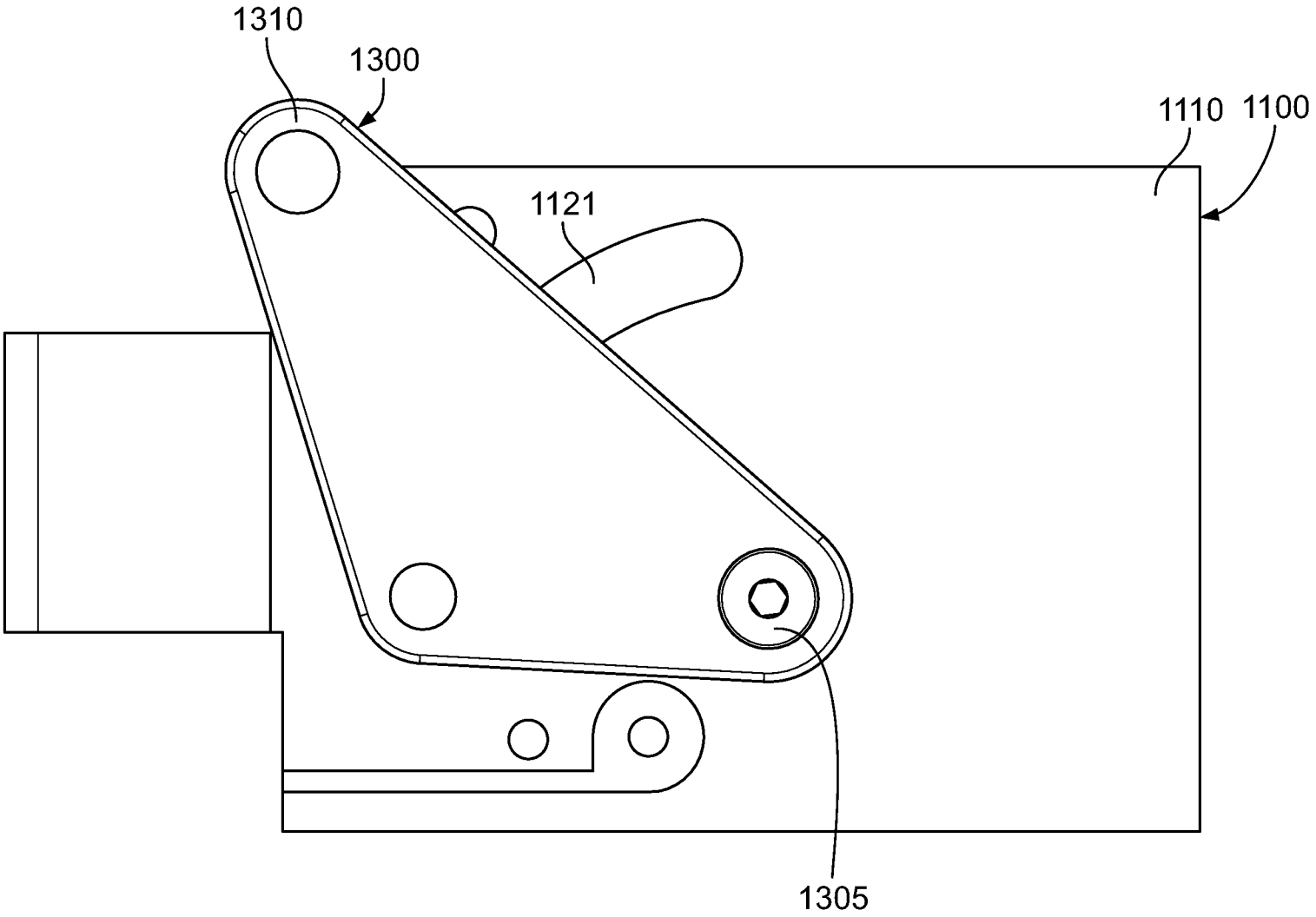
Figure 12D:
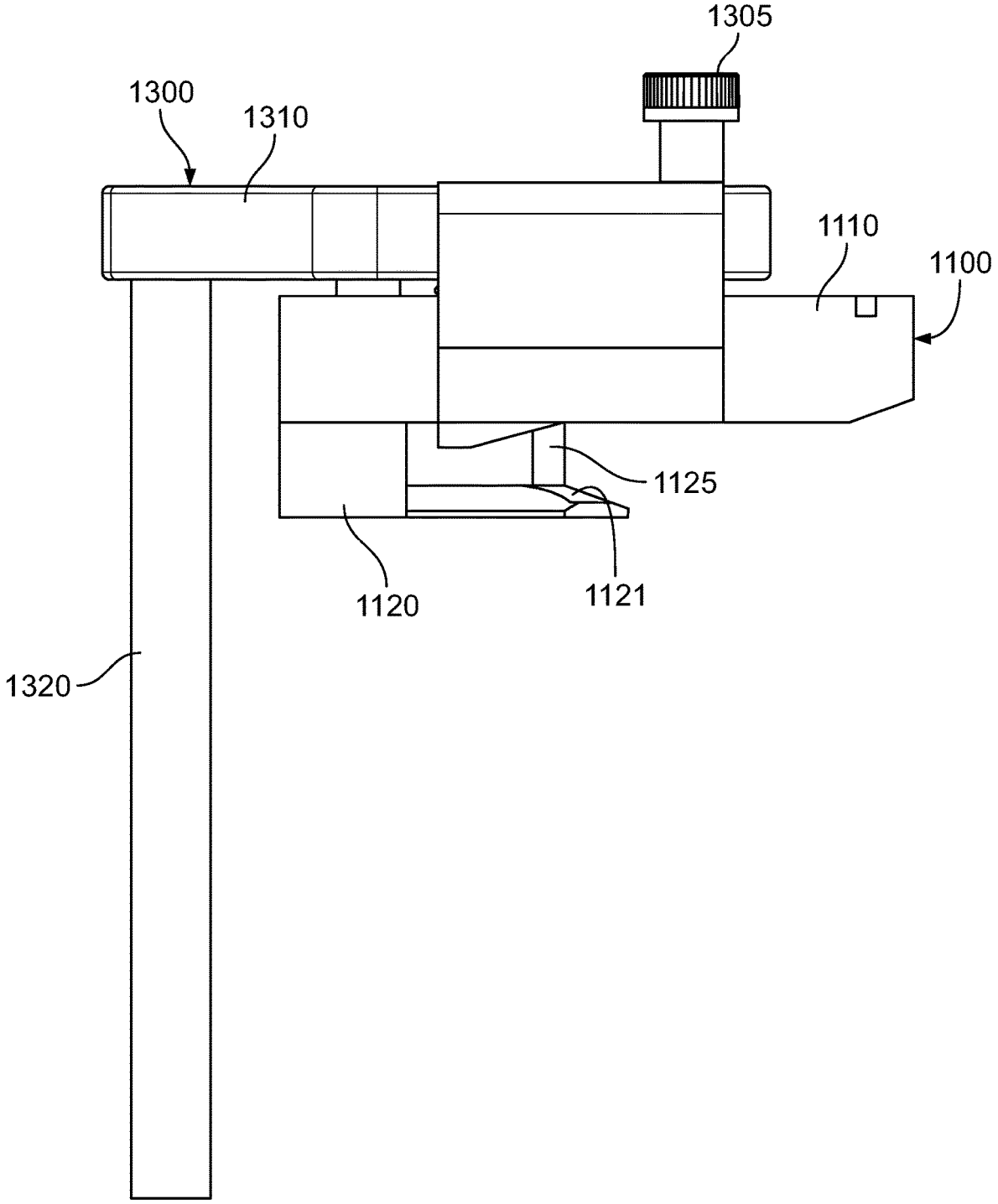
Figure 12E:
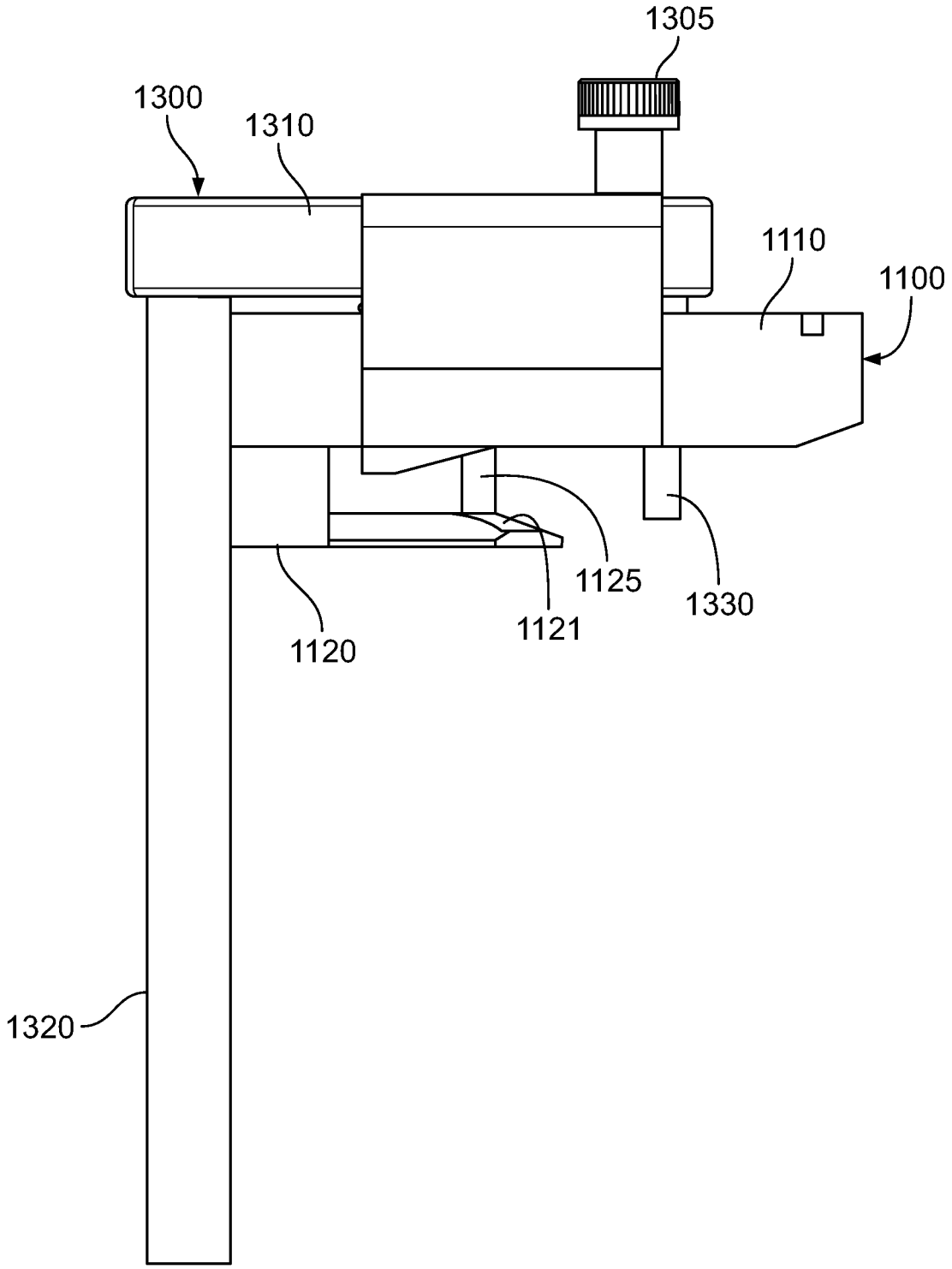

The ejector 1300 is best shown in FIGS. 11-12E and is configured to, upon contacting the load L, eject the edge protector E onto the corner C of the load L. The ejector 1300 includes an ejector plate 1310, a load-contact finger 1320 extending downward from the ejector plate 1310, and an ejection finger 1330 extending downward from the ejector plate 1310. The ejector 1300 is rotatably mounted to the fixed folder portion 1110. More specifically, the ejector plate 1310 is positioned above a top side of the fixed plate 1110 of the fixed folder portion 1100 and is rotatably mounted to the fixed plate 1110 via a pin 1305. Also, the ejector 1300 is positioned so the ejection finger 1330 extends through the curved slot 1115 defined in the fixed plate 1110 of the fixed folder portion 1100 and the load-contact finger 1320 is positioned opposite the first edge-protector-receiving region 1125 defined by the fixed folder portion 1100.

The ejector-biasing element 1400 biases the ejector 1300 to a home position best shown in FIGS. 12A-12C. When the ejector 1300 is in the home position, the load-contact finger 1320 is in its forward-most position (toward the load), and the ejection finger 1330 is positioned at the forward end of the slot 1115 with its lower region positioned in a recess (not shown) defined in the fixed shoe 1120 of the fixed folder portion 1100 so the ejection finger 1330 is not positioned in the first edge-protector-receiving region 1125 of the fixed folder portion 1100. The ejector 1300 is rotatable about the pin 1305 from its home position against the biasing force of the ejector-biasing element 1400 to an ejection position shown in FIGS. 12D and 12E. When the ejector 1300 is in the ejection position, the load-contact finger 1320 is in its rear-most position, and the ejection finger 1330 is positioned at the rear end of the slot 1115 with its lower region positioned in the first edge-protector-receiving region 1125 of the fixed folder portion 1100.

Figure 8:
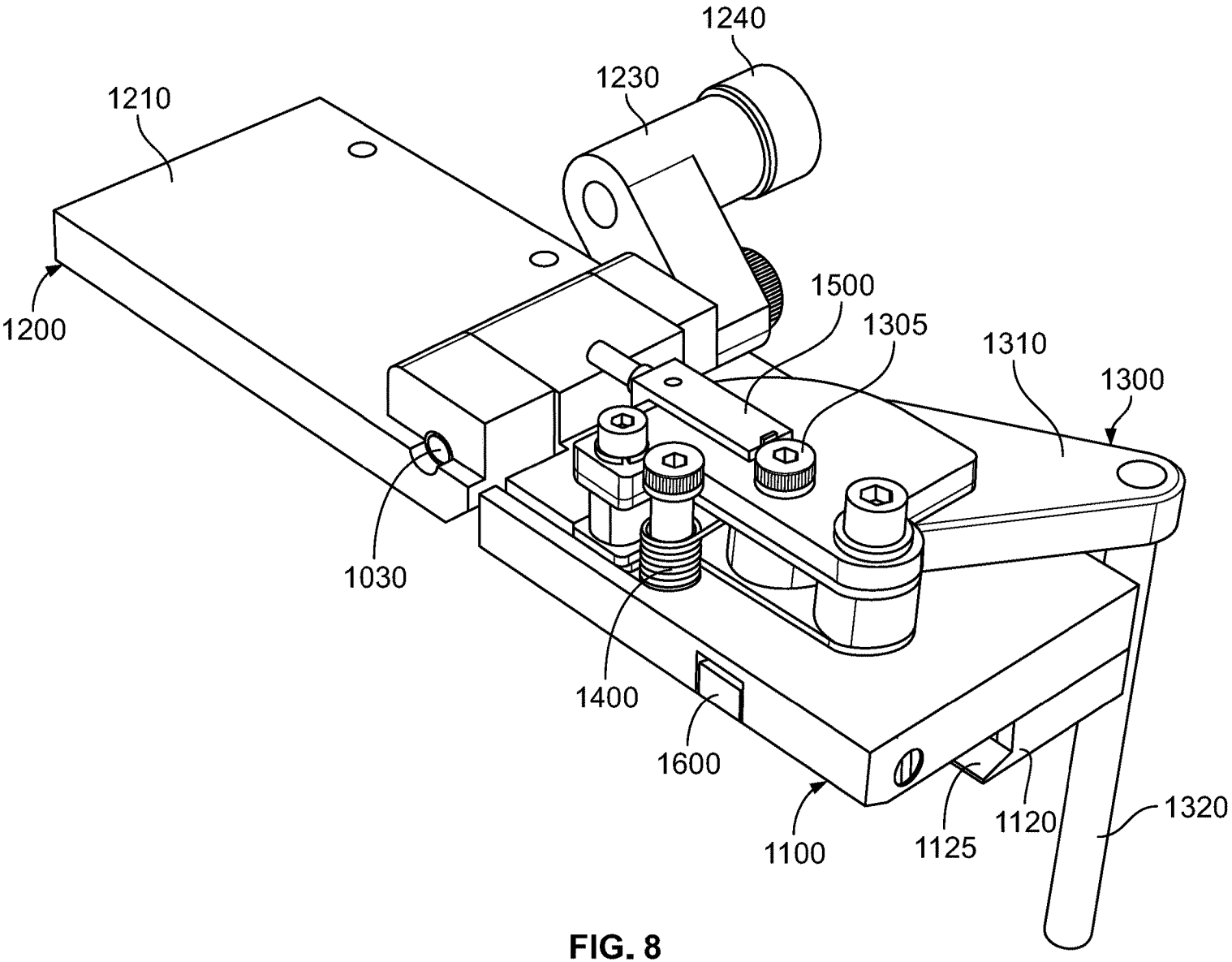
FIGS. 8-10 are perspective views of the shuttle of FIGS. 7A and 7B with certain components removed.
Figure 9:
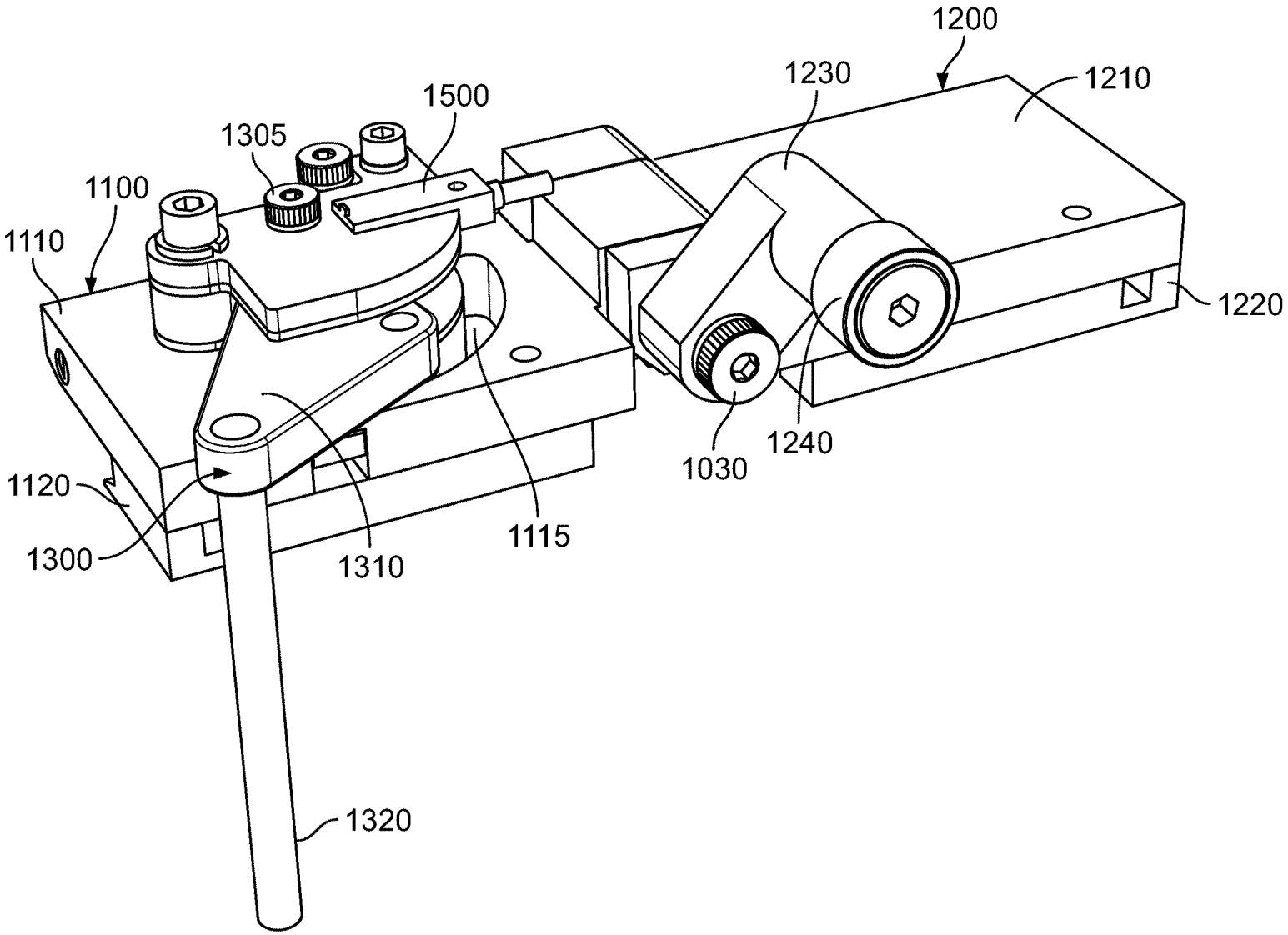
Figure 10:
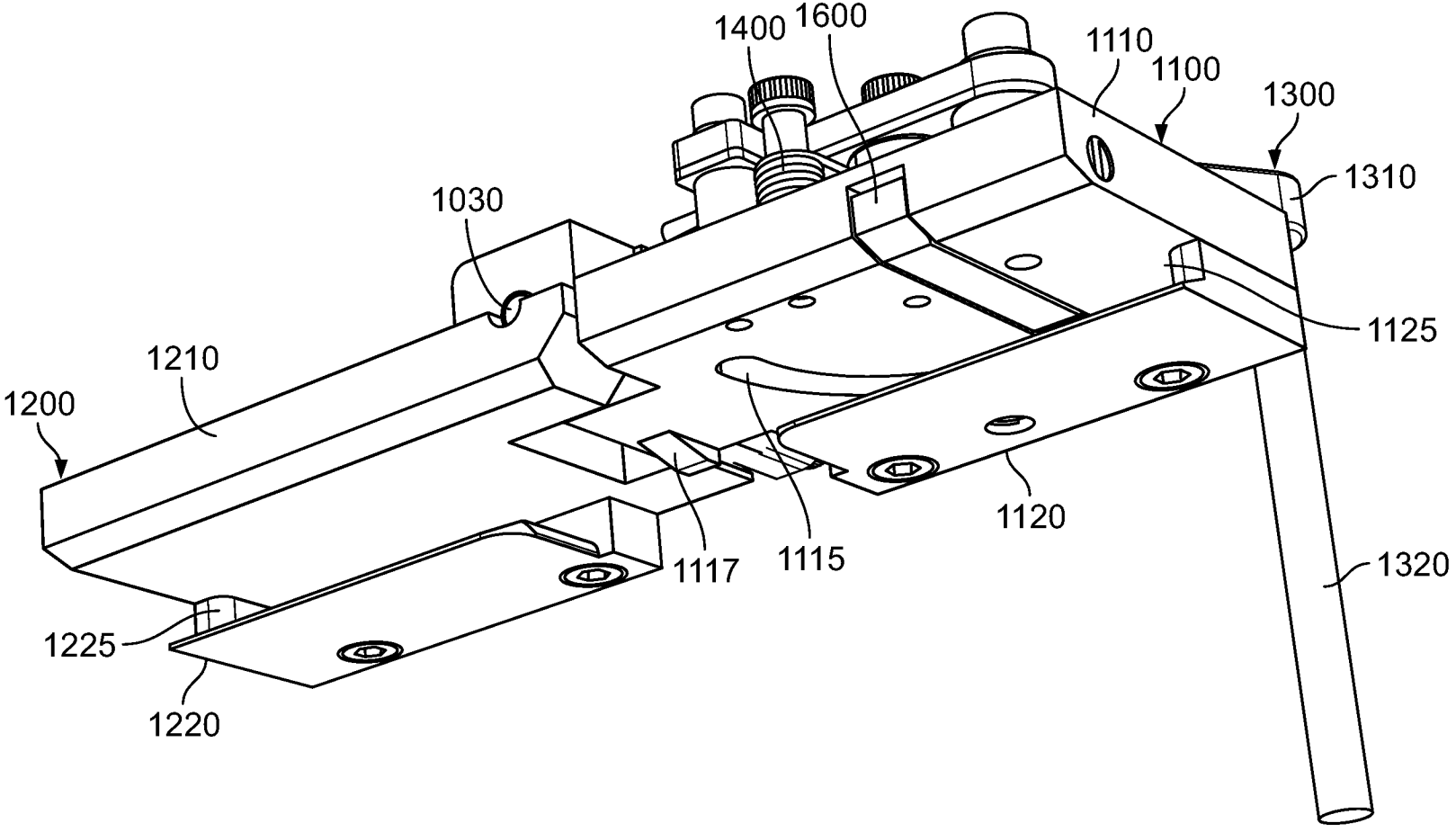

The ejection sensor 1500 is best shown in FIGS. 8 and 9 and is configured to sense the presence (or absence, depending on the embodiment) of the ejector 1300 and communicate a corresponding signal to the controller 1800. The ejection sensor 1500 may be any suitable sensor configured to detect the presence of the ejector 1300, such as an induction sensor, an optical sensor, a mechanical switch, and the like. In this example embodiment, the ejection sensor 1500 is positioned to detect the ejector 1300 (and move particularly, the ejector plate 1310) once the ejector has rotated a designated amount, such as nearly all the way to the ejection position.

The retaining element 1600 is best shown in FIG. 8 and is configured to retain the edge protector E in the first edge-protector-receiving region 1125 of the fixed folder portion 1100 until ejected by the ejection finger 1330 of the ejector 1300. The retaining element 1600 is mounted to the underside of the fixed folder portion 1100 and biased by a biasing element (not shown) to an extended position. When in the extended position, the retaining element extends into the first edge-protector-receiving region 1125. When an edge protector is received in the first edge-protector receiving region 1125, the retaining element 1600 (via the force of the biasing element) pinches the edge protector against the support surface 1121 of the fixed shoe 1120 of the fixed folder portion 1100.

The shuttle 1000 is slidably mounted to the mounting rails 920*a* and 920*b* via the carriage 1005. When the shuttle 1000 is in its home position, the roller 1240 of the movable folder portion 1200 is received in the track 915 in the support 910 of the shuttle assembly 900, as shown in FIGS. 14A-14C. As described below, the orientation of the track 915 controls the orientation of the movable folder portion 1200 relative to the fixed folder portion 1100 and therefore whether the folder is in the receive configuration or the folded configuration.

The controller 1800 includes a processing device (or devices) communicatively connected to a memory device (or devices). For instance, the controller may be a programmable logic controller. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the strapping machine 10 (such as to carry out the load verification and strapping process, as described below).

Figure 3:
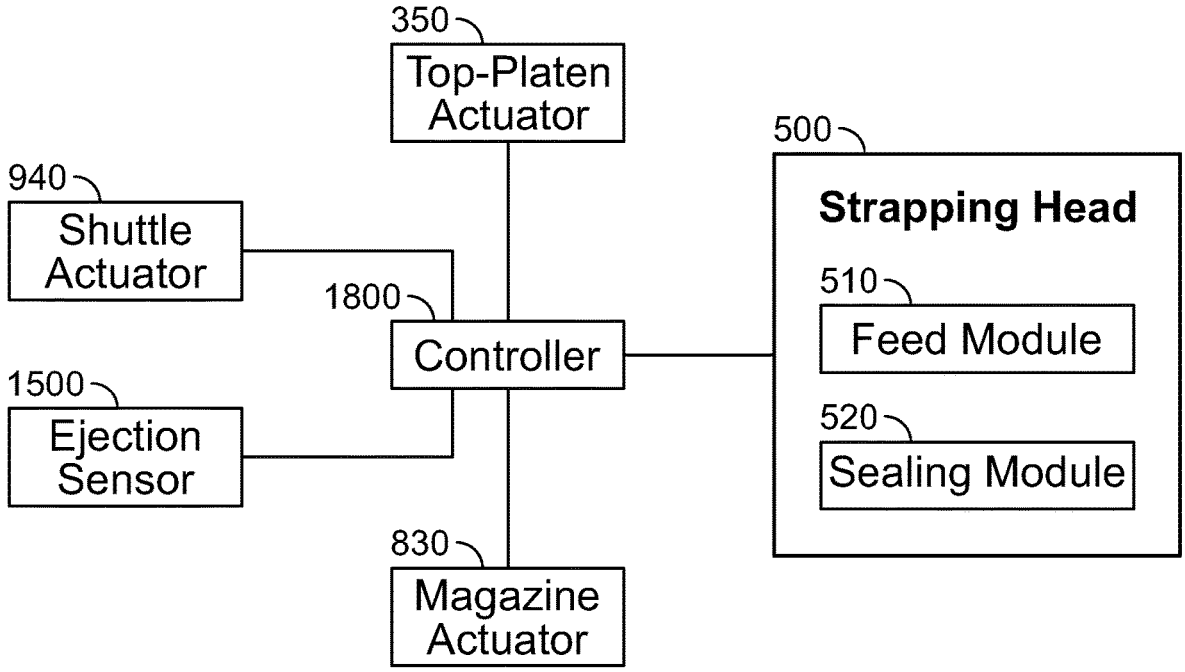
FIG. 3 is a block diagram showing certain components of the strapping machine of FIG. 2.

As shown in FIG. 3, the controller 1800 is communicatively and operably connected to the top-platen actuator 350, the strapping head 500, the magazine actuator 830, and the shuttle actuator 940 to receive signals from and to control those components. The controller 1800 is communicatively connected to the ejection sensor 1500 to receive signals from the ejection sensor 1500.

The controller 1800 is configured to control the shuttle actuator 940 (and thus the position of the shuttle 1000) responsive to signals received from the ejection sensor 1500. In this example embodiment, the controller 1800 is configured to, responsive to receiving a signal from the ejection sensor 1500 that represents the ejection sensor 1500 sensing the ejector plate 1310 of the ejector 1300, control the shuttle actuator 940 to stop moving the shuttle 1000 (and the shuttle 1000 mounted thereto) toward the load L and to move the shuttle 1000 (and the shuttle 1000 mounted thereto) back to the home position.

Figure 15:
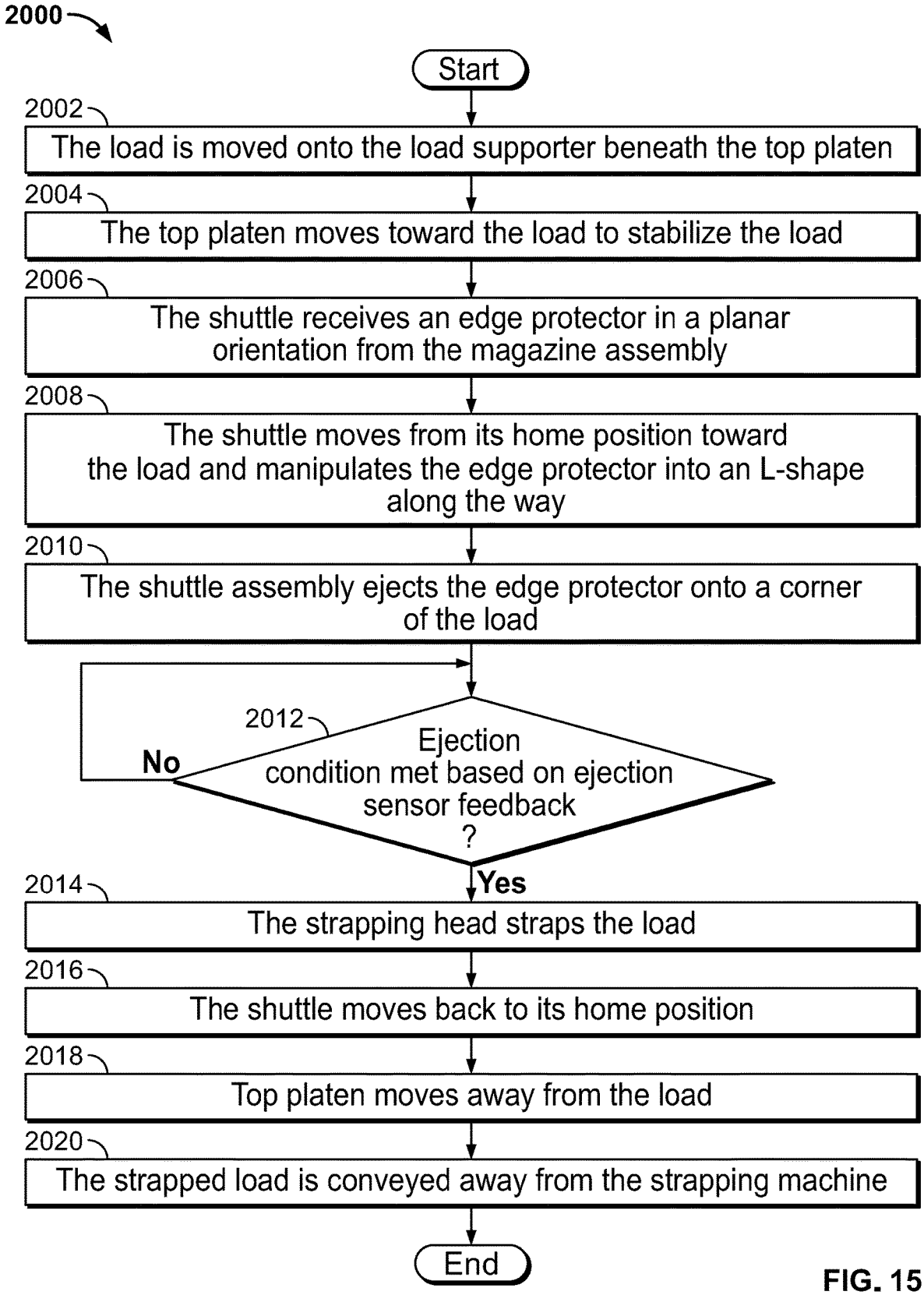
FIG. 15 is a flowchart showing a method of operating the strapping machine of FIG. 2 to carry out an edge-protector-positioning and strapping process.

Operation of the strapping machine 10 to conduct an edge-protector-positioning and strapping process 2000 (referred to below as the "process 2000" for brevity) for a load L is now described in conjunction with the flowchart shown in FIG. 15. Initially, the shuttle 1000 is at its home position and the folder of the shuttle 1000 is in its receive configuration.

Figure 13A:
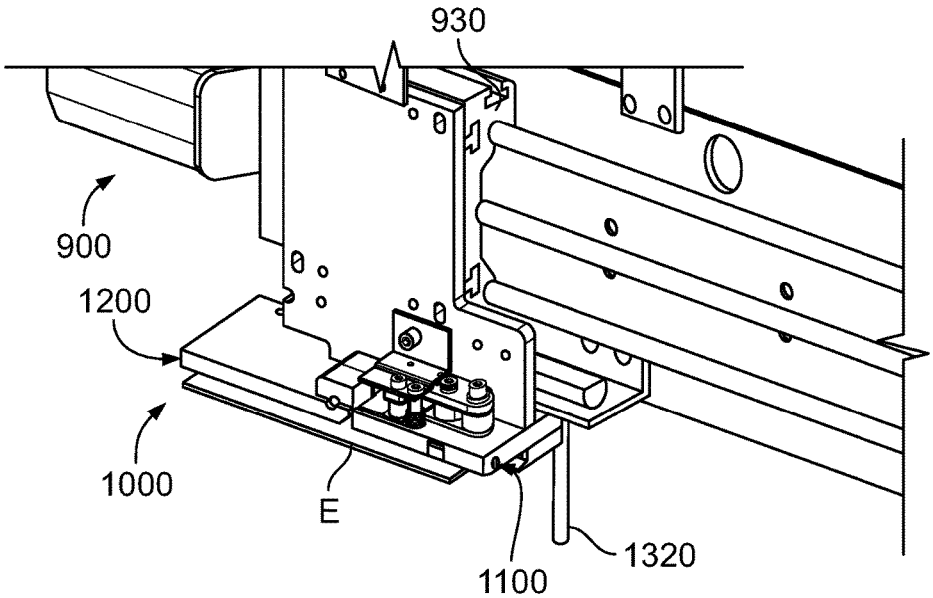
FIGS. 13A-13C are perspective views of the shuttle assembly of FIGS. 6A and 6B from one side and showing the shuttle receiving an edge protector, moving toward the ejection position and folding the edge protector, and ejecting the edge protector.

The load is moved onto the load supporter beneath the top platen of the strapping machine, as block 2002 indicates. With respect to the embodiment described above and shown in the Figures, the load L is moved onto the support surface 210 of the load supporter 200 and beneath the top platen 300. The top platen moves toward the load to stabilize the load, as block 2004 indicates. Continuing with the above example, the controller 1800 controls the top-platen actuator 350 to move the top platen 300 toward the support surface 210 and into contact with the load L to stabilize the load L. The shuttle receives an edge protector in a planar orientation from the magazine assembly, as block 2006 indicates. Continuing with the above example, the controller 1800 controls the magazine actuator 830 to feed an edge protector E in the planar orientation from the magazine assembly 800 to the shuttle 1000. More specifically, the magazine actuator 830 feeds the edge protector E into the first and second edge-protector-receiving regions 1125 and 1225 of the fixed and movable shoes 1120 and 1220 of the fixed and movable folder portions 1100 and 1200 of the shuttle 1000. Once received, the retaining finger 1117 of the fixed folder portion 1100 and the retaining element 1600 hold the edge protector E in place. FIGS. 13A and 14A show the shuttle 1000 holding the edge protector E while in the generally planar orientation.

Figure 13B:
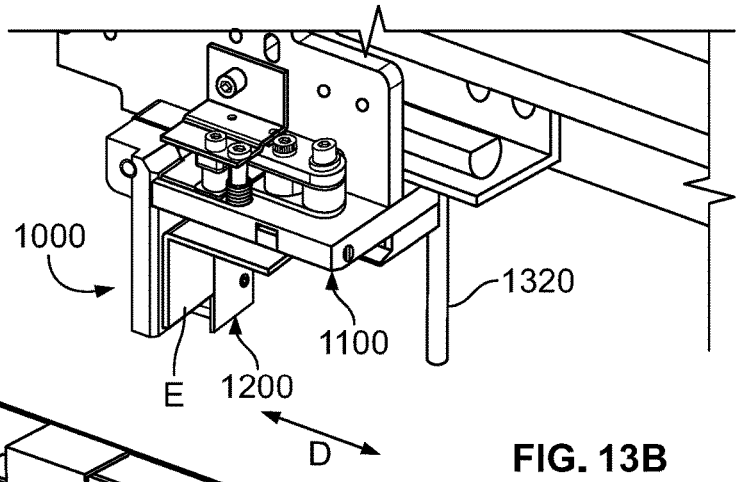
Figure 13C:
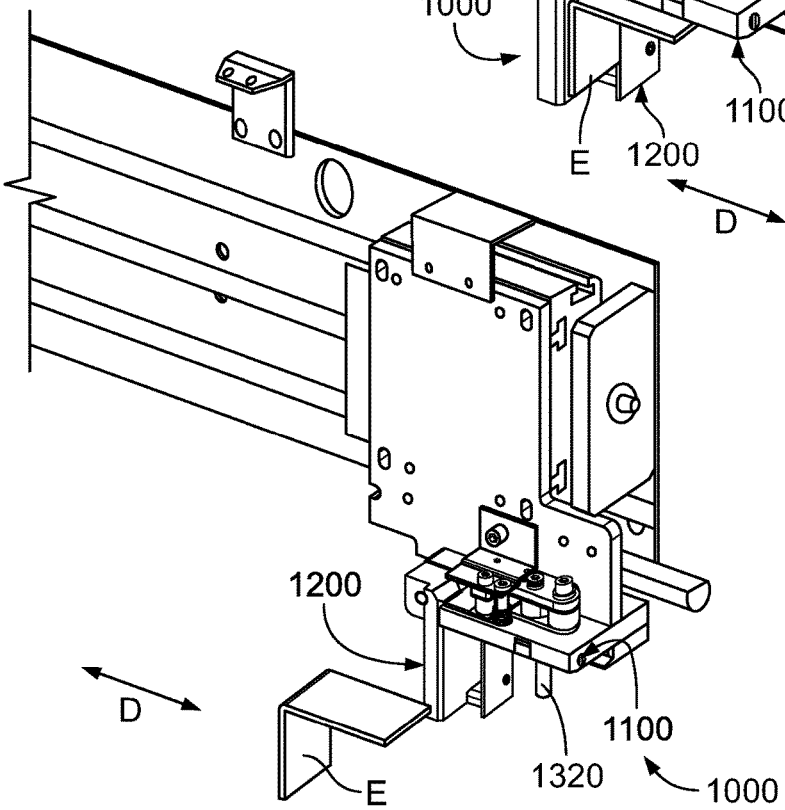

The shuttle moves from its home position toward the load and manipulates the edge protector into an L-shape along the way, as block 2008 indicates. Continuing with the above example, the controller 1800 controls the shuttle actuator 940 to begin moving the shuttle 1000 from the home position toward the ejection position. As best shown in FIGS. 13B and 14B, as the shuttle 1000 moves away from the home position, the orientation of the track 915 formed in the support 910 forces the arm 1230 of the movable folder portion 1200 to rotate the movable folder portion 1200 relative to the fixed folder portion 1100. This manipulates the folder into the fold configuration (also shown in FIG. 7B). As this occurs, the folder folds the edge protector E into an L-shape, as block 2008 also indicates.

The shuttle assembly ejects the edge protector onto a corner of the load, as block 2010 indicates. Continuing with the above example, as the shuttle 1000 moves toward the ejection position, the load-contact finger 1320 of the ejector 1300 contacts the load L. Continued movement of the shuttle 1000 toward the ejection position and relative to the load L forces the ejector 1300 to rotate to the ejection position. As this occurs, the ejection finger 1330 moves into the first edge-protector-receiving region 1125 of the fixed folder portion 1100 and forces the edge protector E out of the edge-protector-receiving regions 1125 and 1225, thereby ejecting the edge protector E onto the corner C of the load L.

The controller determines whether an ejection condition is met based on ejection sensor feedback, as diamond 2012 indicates. Continuing with the above example, as the shuttle 1000 moves toward the ejection position, the controller 1800 periodically determines whether an ejection condition is met based on ejection sensor feedback. In this example embodiment, the ejection condition is met when the controller 1800 receives a signal from the ejection sensor 1500 representing that the ejection sensor 1500 has sensed the ejector plate 1310 of the ejector 1300.

Once the ejection condition is met, the strapping head straps the load, as block 2014 indicates. Continuing with the above example, after the controller 1800 determines that the ejection condition is met (i.e., in this embodiment, after the controller receives a signal from the ejection sensor 1500 representing that the ejection sensor 1500 has sensed the ejector plate 1310 of the ejector 1300), the controller 1800 controls the strapping head 500 to strap the load. For instance, the controller 1800 controls the feed module 510 to feed the strap through the strap chute 400 along the strap path, controls the sealing module 520 to hold the leading strap end, controls the feed module 510 to retract the strap to remove it from the strap chute 400 so it contacts the load, controls the feed module 510 to tension the strap around the load to a designated tension, controls the sealing module 520 to cut the strap from the strap supply to form a trailing strap end, and controls the sealing module 520 to connect the leading strap end and trailing strap end to one another. This is described in more detail in U.S. Pat. No. 7,377,213, though any suitable strapping process may be employed, and may vary based on the type of strapping head and the type of strap.

The shuttle moves back to its home position, as block 2016 indicates, and the top platen moves away from the load, as block 2018 indicates. Continuing with the above example, the controller 1800 controls the shuttle actuator 940 to stop moving the shuttle 1000 to the ejection position and to move back to the home position and controls the top-platen actuator 350 to move the top platen 300 upwardly away from the load L. The strapped load is then conveyed away from the strapping machine, as block 2020 indicates, and the process 2000 ends.

As explained above, one issue with prior art edge-protector positioners is that before the edge-protector positioner reaches the load the optical sensor may sense an object other than the load, such as a bag or top sheet placed on the load. In these instances, since the edge-protector positioner does not contact the load the edge-protector positioner moves back to its home position before ejecting the edge protector onto the load. The strapping machine of the present disclosure solves this problem by using the ejection sensor to verify (in this embodiment, by detecting the position of the ejector) that the shuttle has ejected the edge protector E before returning the shuttle to the home position. This prevents the controller from controlling the shuttle to reverse course and move back to the home position before ejecting the edge protector onto the corner of the load.

In another embodiment, the ejection sensor is positioned to detect the ejector when the ejector is in the home position. In this embodiment, the ejection condition is met a designated period of time after the controller receives a signal from the ejection sensor representing that the ejection sensor no longer detects the ejector. In other words, in this embodiment, the controller stops moving the shuttle to the ejection position and starts moving it back to the home position a designated period of time after the ejector moves away from the home position.

In another embodiment, the ejection sensor is positioned to detect another component of the ejector, such as the ejection finger, instead of the ejection plate.

In another embodiment, the ejection sensor is positioned to detect the presence of an edge protector within one of the edge-protector-receiving regions of the folder of the shuttle. In this embodiment, the ejection condition is met after the controller receives a signal from the ejection sensor representing that the ejection sensor no longer detects the edge protector.

Various embodiments of the strapping machine of the present disclosure comprise a frame; a load supporter supported by the frame; a shuttle movable relative to the load supporter between a home position and an ejection position, the shuttle configured to receive an edge protector, the shuttle comprising: an ejector movable from a home position to an ejection position to eject the edge protector from the shuttle; and an ejection sensor configured to detect the ejector; a strapping head; and a controller operably connected to the shuttle to control the shuttle to move between the home and ejection positions and communicatively connected to the ejection sensor, the controller configured to: control the shuttle to move from the home position to the ejection position; responsive to an ejection condition being met based on feedback from the ejection sensor as the shuttle moves to the ejection position, control the shuttle to move back to the home position; and control the strapping head to strap the load.

In certain such embodiments, the ejection condition is met when the ejection sensor detects the ejector.

In certain such embodiments, the ejection sensor is configured to detect the ejector after the ejector moves away from the home position.

In certain such embodiments, the ejection sensor is configured to detect the ejector when the ejector reaches the ejection position.

In certain such embodiments, the ejection sensor includes an inductive sensor and the ejector is at least partially made of metal.

In certain such embodiments, the ejection sensor is configured to detect the ejector when the ejector is in the home position, and the ejection condition is met when a designated time period expires after the ejection sensor stops detecting the ejector when the ejector moves from the home position.

In certain such embodiments, the shuttle comprises a folder configured to receive the edge protector in a generally planar orientation and to fold the edge protector into an L-shape.

In certain such embodiments, the controller is further configured to control the strapping head to strap the load after the ejection condition is met.

Various methods of operating a strapping machine of the present disclosure to position an edge protector on a load and to strap the load comprise moving a shuttle carrying the edge protector from a home position toward the load; ejecting, via an ejector of the shuttle, the edge protector onto the corner of the load; and after an ejection condition is met based on feedback from an ejection sensor configured to detect the ejector, moving the shuttle back to the home position; and strapping the load.

In certain such embodiments, the method further comprises detecting, via the ejection sensor, the ejector, wherein the ejection condition is met when the ejection sensor detects the ejector.

In certain such embodiments, the method further comprises detecting, via the ejection sensor, the ejector after the ejector moves away from the home position.

In certain such embodiments, the method further comprises detecting, via the ejection sensor, the ejector when the ejector reaches the ejection position.

In certain such embodiments, the ejection sensor is configured to detect the ejector when the ejector is in the home position, and the method further comprises determining that the ejector has moved from the home position based on feedback from the ejection sensor, wherein the ejection condition is met when a designated time period expires after the ejection sensor stops detecting the ejector when the ejector moves from the home position.

In certain such embodiments, the method further comprises receiving, via a folder of the shuttle, the edge protector in a generally planar orientation and folding, via the folder of the shuttle, the edge protector into an L-shape as the shuttle moves from the home position toward the load.

In certain such embodiments, the method further comprises strapping the load after the ejection condition is met.

The invention claimed is:

1. A strapping machine for positioning an edge protector on a corner of a load and for strapping the load, the strapping machine comprising:

a frame;

a load supporter supported by the frame;

a shuttle movable relative to the load supporter between a shuttle home position and a shuttle ejection position, the shuttle configured to receive the edge protector, the shuttle comprising:

an ejector movable from an ejector home position to an ejector ejection position to eject the edge protector from the shuttle; and an ejection sensor configured to detect the presence of the ejector;

a strapping head; and a controller operably connected to the shuttle to control the shuttle to move between the shuttle home and shuttle ejection positions and communicatively connected to the ejection sensor, the controller configured to:

control the shuttle to move from the shuttle home position to the shuttle ejection position;

responsive to an ejection condition being met based on feedback from the ejection sensor as the shuttle moves to the shuttle ejection position, control the shuttle to move back to the shuttle home position; and control the strapping head to strap the load.

2. The strapping machine of claim 1, wherein the ejection condition is met when the ejection sensor detects the presence of the ejector.

3. The strapping machine of claim 2, wherein the ejection sensor is configured to detect the presence of the ejector after the ejector moves away from the ejector home position.

4. The strapping machine of claim 3, wherein the ejection sensor is configured to detect the presence of the ejector when the ejector reaches the ejector ejection position.

5. The strapping machine of claim 4, wherein the ejection sensor includes an inductive sensor and the ejector is at least partially made of metal.

6. The strapping machine of claim 1, wherein the ejection sensor is configured to detect the presence of the ejector when the ejector is in the ejector home position, and wherein the ejection condition is met when a designated time period expires after the ejection sensor stops detecting the presence of the ejector when the ejector moves from the ejector home position.

7. The strapping machine of claim 1, wherein the shuttle comprises a folder configured to receive the edge protector in a generally planar orientation and to fold the edge protector into an L-shape.

8. The strapping machine of claim 1, wherein the controller is further configured to control the strapping head to strap the load after the ejection condition is met.

* * * * *